US012370415B2

(12) United States Patent
Nakamura et al.

(10) Patent No.: US 12,370,415 B2
(45) Date of Patent: Jul. 29, 2025

(54) GOLF CLUB HEAD

(71) Applicant: Sumitomo Rubber Industries, Ltd., Kobe (JP)

(72) Inventors: Takashi Nakamura, Kobe (JP); Daisuke Kohno, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 18/116,325

(22) Filed: Mar. 2, 2023

(65) Prior Publication Data

US 2023/0277902 A1 Sep. 7, 2023

(30) Foreign Application Priority Data

Mar. 3, 2022 (JP) ..... 2022-032345

(51) Int. Cl.
*A63B 53/04* (2015.01)
*A63B 102/32* (2015.01)

(52) U.S. Cl.
CPC ..... *A63B 53/04* (2013.01); *A63B 2053/0491* (2013.01); *A63B 2102/32* (2015.10)

(58) Field of Classification Search
CPC ..... A63B 2053/0491
See application file for complete search history.

(56) References Cited

U.S. PATENT DOCUMENTS 5,769,737 A * 6/1998 Holladay ..... A63B 53/06 473/340
6,015,354 A * 1/2000 Ahn ..... A63B 53/04 473/341
7,775,905 B2 * 8/2010 Beach ..... A63B 60/00 473/256
8,696,491 B1 * 4/2014 Myers ..... A63B 60/02 473/345
9,199,145 B1 * 12/2015 Myers ..... A63B 53/0466
9,289,660 B1 * 3/2016 Myers ..... A63B 53/0466
9,364,728 B1 * 6/2016 Myers ..... A63B 60/52
9,381,410 B2 * 7/2016 Golden ..... A63B 53/0466
9,387,376 B1 * 7/2016 Hall ..... A63B 53/06
9,597,561 B1 * 3/2017 Seluga ..... A63B 60/52
9,623,294 B1 * 4/2017 Kingston ..... A63B 60/52
9,675,856 B1 * 6/2017 Gibbs ..... A63B 53/047
9,682,298 B1 * 6/2017 Kingston ..... A63B 53/0466
9,694,256 B2 * 7/2017 Myers ..... A63B 53/0466
9,724,577 B1 * 8/2017 Kingston ..... A63B 53/0466
(Continued)

*Primary Examiner* — William M Pierce
(74) *Attorney, Agent, or Firm* — XSENSUS LLP

(57) ABSTRACT

A golf club head includes a weight object and a weight object receiving portion that is provided on an outer surface of the head and in which at least a part of the weight object is housed. The weight object or the weight object receiving portion includes a shape change mechanism that enables the weight object or the weight object receiving portion to change a shape of itself. The weight object receiving portion includes: a rotational force applying part that applies a rotational force on the weight object as a reaction generated when the weight object is pressed by the shape change; and a rotation prevention part that is located at a position abutting against the weight object when the rotational force is applied and that stops the weight object from being rotated by the rotational force and prevents rotation of the weight object.

15 Claims, 19 Drawing Sheets

(56) References Cited

U.S. PATENT DOCUMENTS

| | | | | |
|---|---|---|---|---|
| 9,731,178 | B1 * | 8/2017 | Myers | A63B 60/04 |
| 9,757,630 | B2 * | 9/2017 | Mata | A63B 53/0466 |
| 9,795,846 | B2 * | 10/2017 | Sargent | A63B 60/02 |
| D813,333 | S * | 3/2018 | Tang | D21/759 |
| 9,975,019 | B2 * | 5/2018 | Frame | A63B 53/0466 |
| 10,046,212 | B2 * | 8/2018 | Sargent | A63B 53/0466 |
| 10,076,688 | B1 * | 9/2018 | Harbert | A63B 60/00 |
| 10,398,952 | B1 * | 9/2019 | Yi | A63B 53/0433 |
| 10,576,337 | B2 * | 3/2020 | Soracco | A63B 60/52 |
| 11,331,547 | B2 * | 5/2022 | Hoffman | A63B 60/00 |
| 2014/0187347 | A1 | 7/2014 | Yamamoto | |
| 2018/0065005 | A1 * | 3/2018 | Cleghorn | A63B 53/0466 |
| 2019/0192928 | A1 * | 6/2019 | Soracco | A63B 60/04 |
| 2023/0277902 | A1 * | 9/2023 | Nakamura | A63B 53/04 |

* cited by examiner

GOLF CLUB HEAD

CROSS REFERENCE TO RELATED APPLICATION

The present application claims priority to Japanese Patent Application No. 2022-32345 filed on Mar. 3, 2022. The entire contents of this Japanese Patent Application are hereby incorporated by reference.

BACKGROUND

Technical Field

The present disclosure relates to golf club heads.

Description of the Related Art

There has been known a golf club head that includes an attachable/detachable weight object. JP2014-128312A (US2014/0187347A1) discloses a weight object that can be attached to a golf club head by rotating the weight object +θ° and can be detached from the golf club head by rotating the weight object −θ°.

SUMMARY

The inventors of the present disclosure have found a new structure for fixing a weight object to a head body. The inventors have also found that this fixing structure provides new advantageous effects.

One of the objects of the present disclosure is to provide a golf club head that includes a new structure for fixing a weight object.

In one aspect, a golf club head includes a weight object and a weight object receiving portion that is provided on the outer surface of the golf club head and to which the weight object is attached. The weight object is shiftable between a fixed state and an unfixed state when the weight object is disposed in the weight object receiving portion. The weight object or the weight object receiving portion has a shape change mechanism that enables the weight object or the weight object receiving portion to change a shape of itself. The weight object receiving portion includes: a rotational force applying part that is configured to apply a rotational force to the weight object, the rotational force being caused as a reaction generated when the weight object is pressed against the weight object receiving portion by the change of the shape of the weight object or the weight object receiving portion; and a rotation prevention part that is located at a position against which the weight object abuts when the rotational force is applied to the weight object, and that is configured to stop the weight object from being rotated by the rotational force to prevent rotation of the weight object. The fixed state is achieved by maintaining a state in which the weight object is pressed against the rotation prevention part by the rotational force.

BRIEF DESCRIPTION OF THE DRAWINGS

FIG. 8A shows an unfixed state, and FIG. 8B shows a fixed state;

FIG. 10A shows a dimensional relationship between the weight object and the weight object receiving portion, FIG. 10B shows an unfixed state, FIG. 10C shows a fixed state, and FIG. 10D shows forces acting on the weight object when the weight object is in the fixed state;

FIG. 11A shows a dimensional relationship between the weight object and the weight object receiving portion, FIG. 11B shows an unfixed state, FIG. 11C shows a fixed state, and FIG. 11D shows forces acting on the weight object when the weight object is in the fixed state;

FIG. 12A shows a dimensional relationship between the weight object and the weight object receiving portion, FIG. 12B shows an unfixed state, FIG. 12C shows a fixed state, and FIG. 12D shows forces acting on the weight object when the weight object is in the fixed state;

FIG. 16B shows a fixed state;

DESCRIPTION OF THE PREFERRED EMBODIMENTS

Hereinafter, embodiments will be described in detail with appropriate references to the accompanying drawings.

In the present disclosure, a reference state, a reference perpendicular plane, a toe-heel direction, a face-back direction, a top-sole direction, and a face center are defined as follows.

Figure 19:
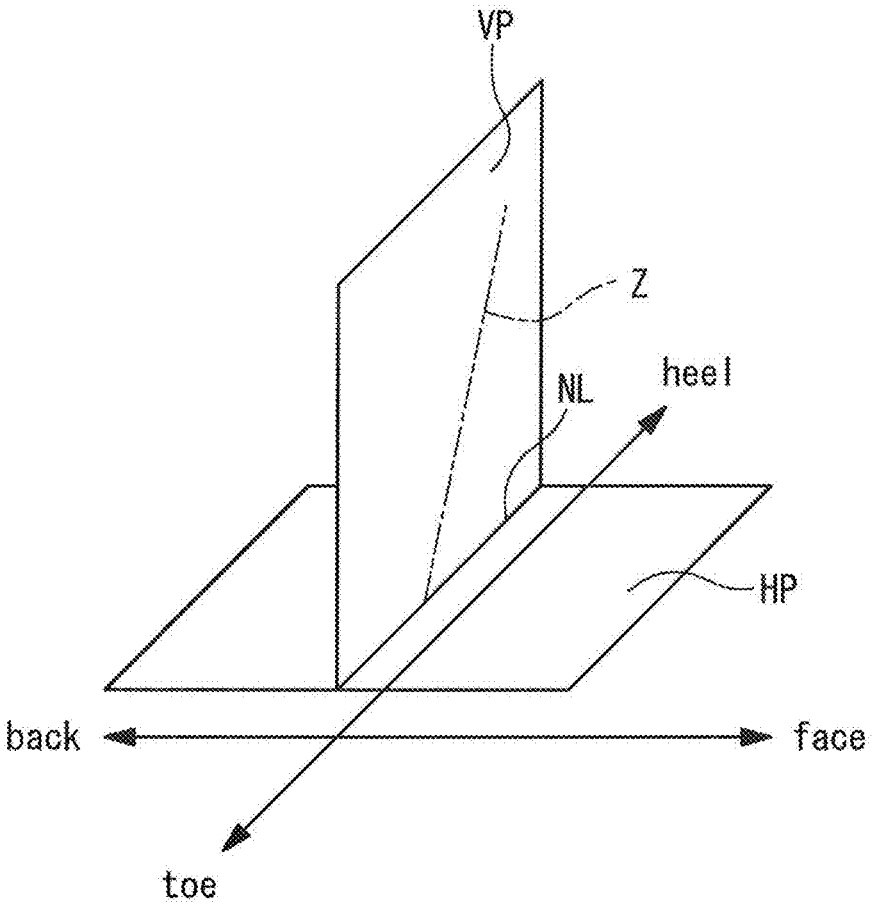
FIG. 19 is a conceptual diagram for illustrating a reference state.

The reference state is a state where a head is placed at a predetermined lie angle on a ground plane HP. As shown in FIG. 19, in the reference state, a shaft axis line Z lies on (is contained in) a plane VP that is perpendicular to the ground plane HP. The shaft axis line Z is the center line of a shaft. The shaft axis line Z usually coincides with the center line of a hosel hole. The plane VP is defined as the reference perpendicular plane. The predetermined lie angle is shown in a product catalog, for example.

In the reference state, a face angle is 0°. That is, in a planar view of a head as viewed from above, a line normal to its striking face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 19).

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the top-sole direction is a direction that is perpendicular to the toe-heel direction and is perpendicular to the face-back direction. In other words, the top-sole direction in the present disclosure is a direction perpendicular to the ground plane HP.

In the present disclosure, the face center is determined in the following manner. First, a point Pr is selected roughly at the center of a striking face in the top-sole direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the top-sole direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the top-sole direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

Figure 1:
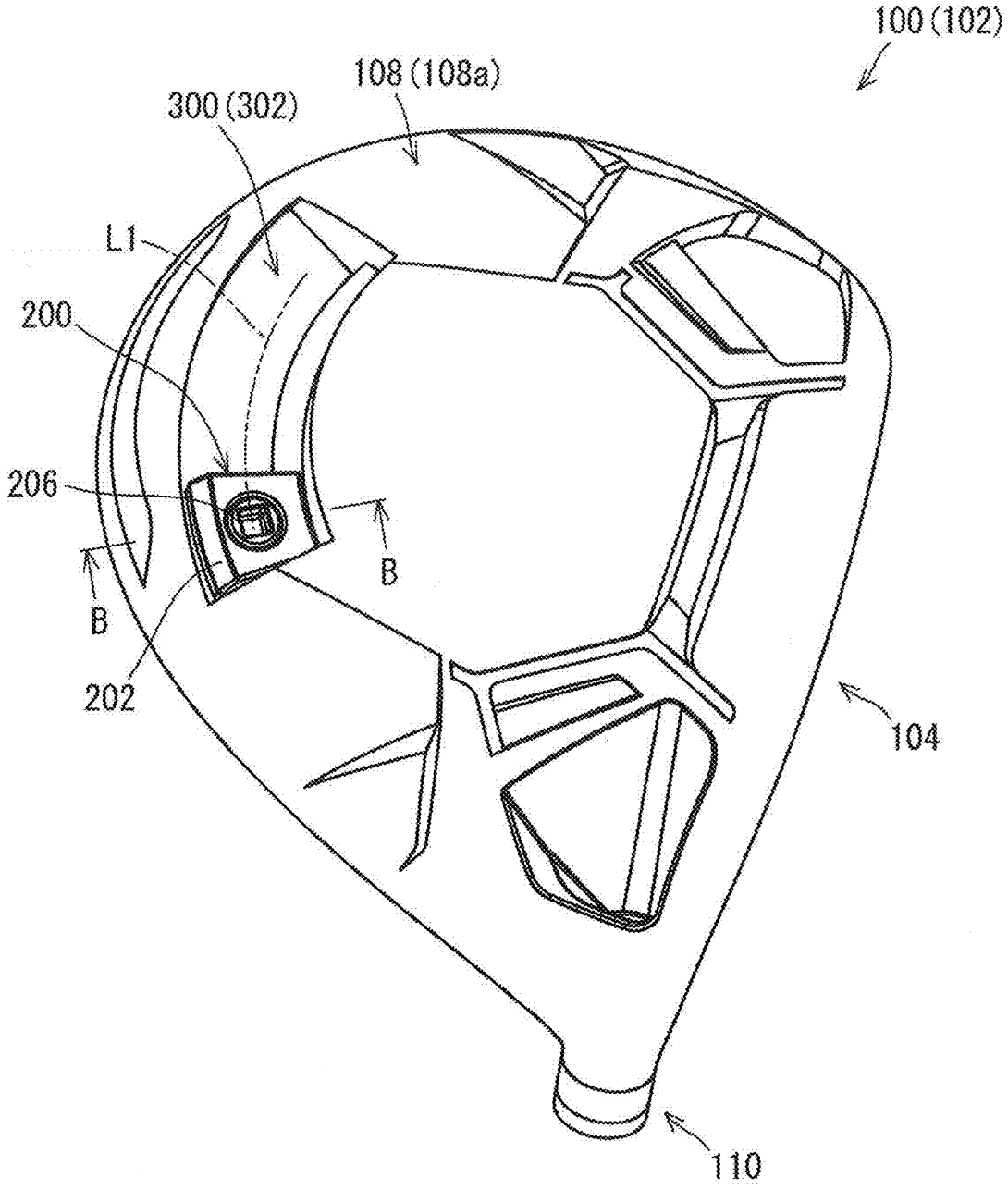
FIG. 1 shows a perspective view of a golf club head according to a first embodiment.
Figure 2:
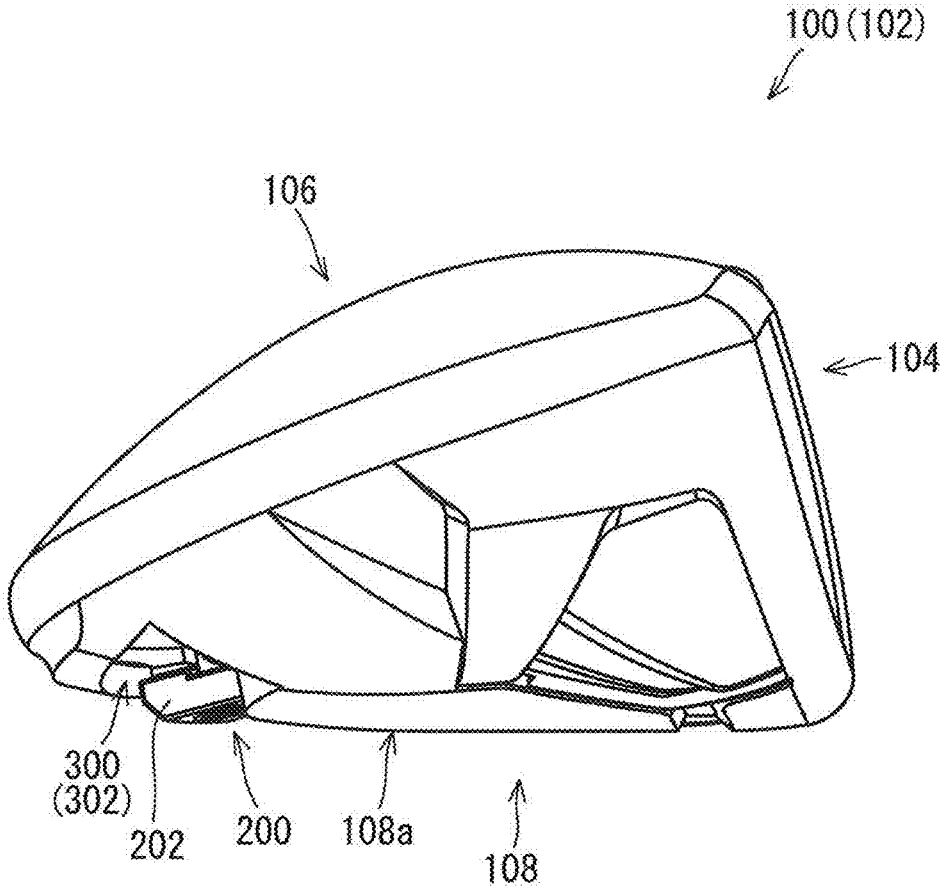
FIG. 2 is a side view of the head in FIG. 1 as viewed from a toe side.
Figure 3:
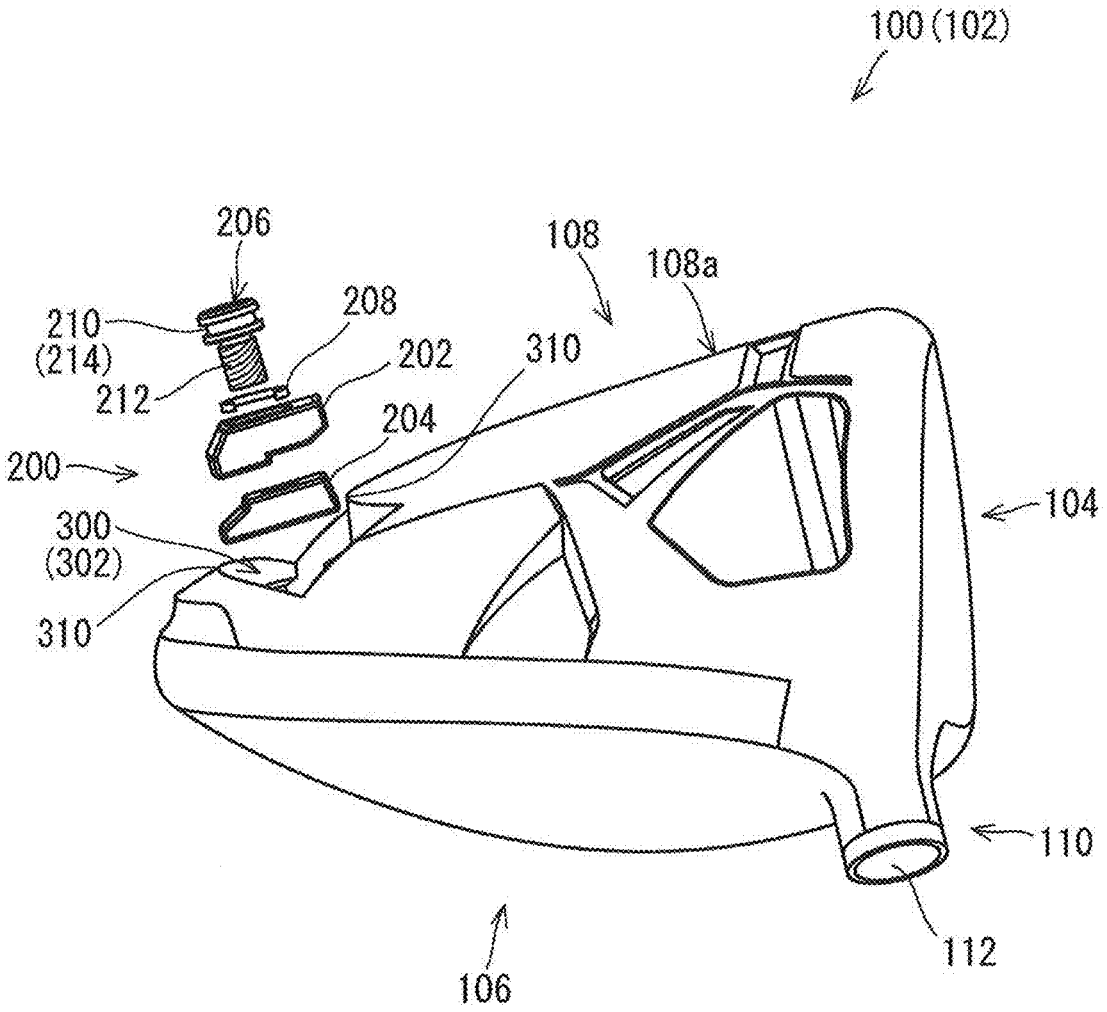
FIG. 3 is an exploded perspective view of the head in FIG. 1.
Figure 4:
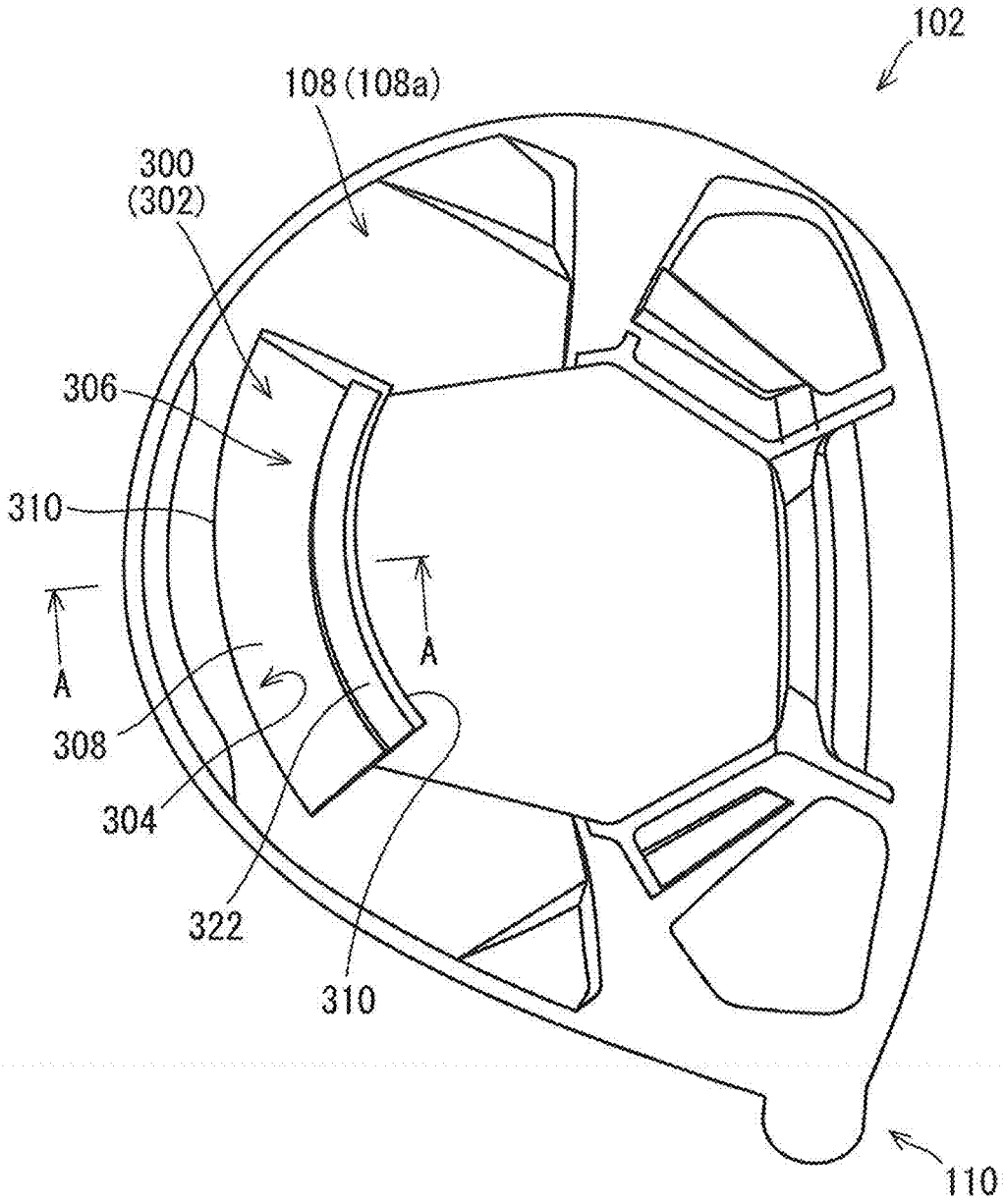
FIG. 4 is a bottom view of a head body of the head in FIG. 1 as viewed from a sole side.

FIG. 1 is a perspective view of a head 100 according to a first embodiment as viewed from a sole side. FIG. 2 is a side view of the head 100 as viewed from a toe side. FIG. 3 is an exploded perspective view of the head 100. FIG. 4 is a bottom view of a head body 102 of the head 100 as viewed from the sole side.

The head 100 (head body 102) includes a face portion 104, a crown portion 106, a sole portion 108 and a hosel portion 110. The hosel portion 100 has a hosel hole 112.

The head 100 includes a weight object 200. The head 100 is constituted by the weight object 200 and the head body 102. As shown in FIG. 3, the weight object 200 includes an outer member 202, an inner member 204, and a coupling member 206. The outer member 202 is positioned on the outer side of the head 100 relative to the inner member 204. The coupling member 206 connects the outer member 202 and the inner member 204. The coupling member 206 in the present embodiment is a screw. The weight object 200 further includes a washer 208. The washer 208 is a C-shaped member. The coupling member 206 includes a head portion 210 and a screw portion 212. The screw portion 212 constitutes a male screw. The head 210 includes an outer circumferential surface that has a circumferential groove 214.

The terms "outer member" and "inner member" are used to distinguish the members from each other. From this viewpoint, the "outer member" may also be simply referred to as a first member, and the "inner member" may also be simply referred to as a second member.

The head 100 includes a weight object receiving portion 300. The weight object 200 is attached to the weight object receiving portion 300. The weight object receiving portion 300 is provided on the outer surface of the head 100. The weight object receiving portion 300 is provided in the sole portion 108. The weight object receiving portion 300 constitutes a groove 302. In the planer view (FIG. 4), the groove 302 extends along the peripheral edge of the head 100. In the planer view (FIG. 4), the groove 302 extends along the peripheral edge of the sole portion 108.

Alternatively, the weight object receiving portion 300 may be provided in a portion other than the sole portion. For example, the weight object receiving portion 300 may be provided in the crown portion, or may be provided in a side portion (skirt portion) disposed between the crown portion and the sole portion.

When the weight object 200 is not fixed to the weight object receiving portion 300 (hereinafter, this state is also referred to as an "unfixed state"), the weight object 200 is movable (slidable) in the groove 302. As described below, the weight object receiving portion 300 includes a first wall 304, and a second wall 306 that is positioned opposite to the first wall 304. When the weight object 200 is in the unfixed state, the weight object 200 can move in the weight object receiving portion 300 while being guided by the first wall 304 and the second wall 306. The weight object 200 can be fixed to the weight object receiving portion 300 at all positions (at any intended position) in the moving direction (hereinafter, this state is also referred to as a "fixed state"). A part of the weight object 200 is exposed to the outside of the head 100.

Figure 5:
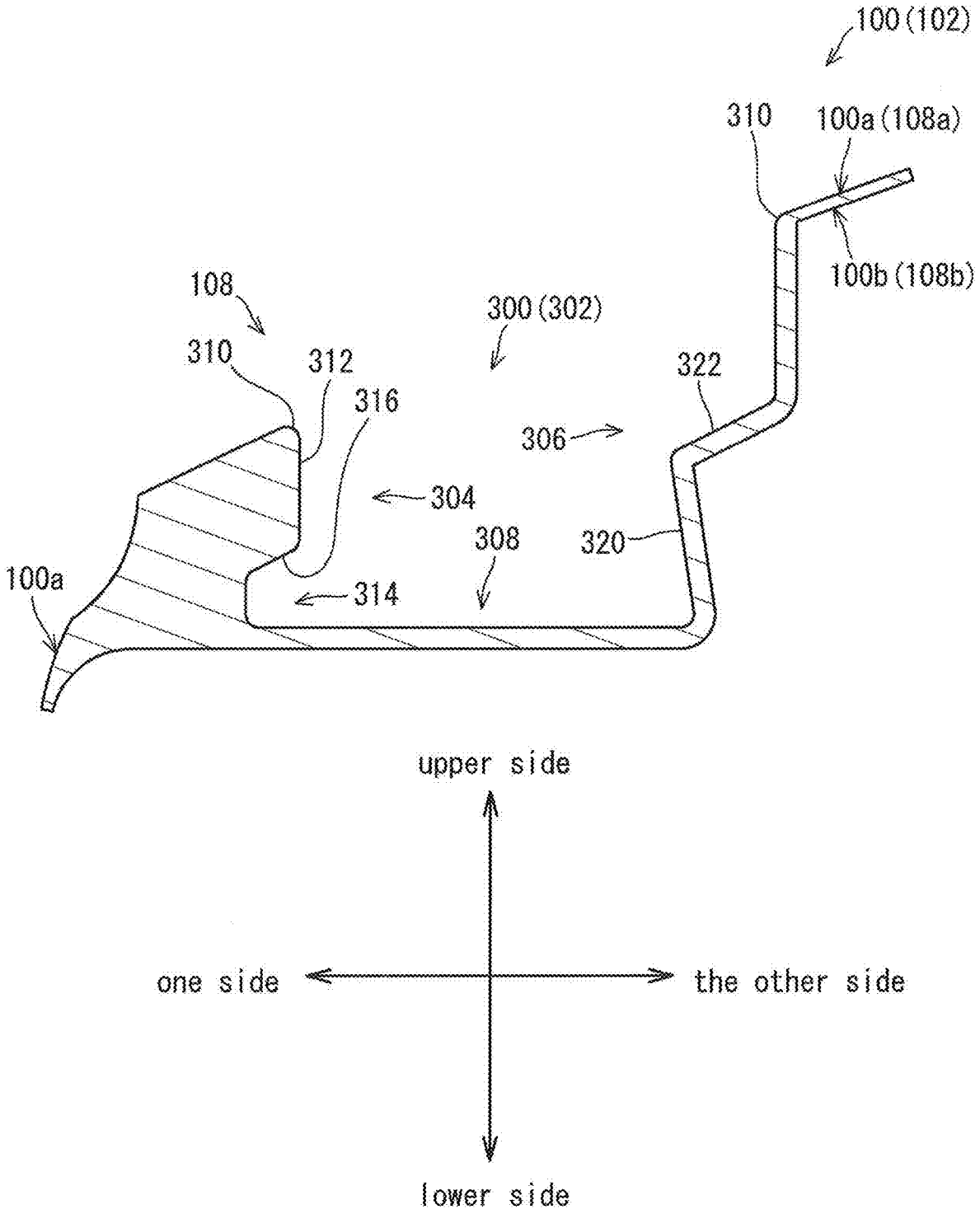
FIG. 5 is a cross-sectional view of the head body taken along line A-A in FIG. 4.

FIG. 5 is a cross-sectional view taken along line A-A in FIG. 4. The head 100 (head body 102) has a hollow structure. The head 100 (head body 102) includes a head outer surface 100*a* and a head inner surface 100*b*. The head inner surface 100*b* faces a hollow interior of the head 100. The sole portion 108 includes a sole outer surface 108*a* and a sole inner surface 108*b*. The weight object receiving portion 300 is a recess provided on the head outer surface 100*a*. The weight object receiving portion 300 is a recess provided on the sole outer surface 108*a*. The weight object receiving portion 300 houses at least a part of the weight object 200.

The terms "one side" and "the other side" are used for the weight object receiving portion 300. "One side" and "the other side" are positioned opposite to each other. The terms "one side" and "the other side" only mean these are positioned on opposite sides relative to each other. The one side is not limited to a fixed direction. The other side is not limited to a fixed direction, either. In the present embodiment (FIG. 5), one side means the back side and the other side means the face side.

The terms "upper side" and "lower side" are used for the weight object receiving portion 300. The upper side and the lower side are positioned opposite to each other. In the present embodiment (FIG. 5), the upper side means the opening side of the weight object receiving portion 300 and the outer side of the head 100. The lower side means the bottom side of the weight object receiving portion 300 and the inner side of the head 100. The terms upward and downward are also used for respectively meaning a direction toward the upper side and a direction toward the lower side.

The above four directions (one side, the other side, upper side or upward and lower side or downward) used for the weight object receiving portion 300 are also used for the weight object 200 housed in the weight object receiving portion 300. In this case, a rotational center line z1 of the coupling member 206 of the weight object 200 can be considered as extending in the up-down direction (see FIG. 6 described below).

As shown in FIG. 5, the weight object receiving portion 300 includes the first wall 304 and the second wall 306. The second wall 306 is positioned opposite to the first wall 304. The first wall 304 is a wall on the one side. The second wall 306 is a wall on the other side. The weight object receiving portion 300 also includes a bottom portion 308. The bottom portion 308 connects the lower end of the first wall 304 and the lower end of the second wall 306. The upper end of the first wall 304 and the upper end of the second wall 306 are an opening edge 310 of the weight object receiving portion 300 (see FIG. 4).

The first wall 304 includes an erecting surface 312 that faces the other side, and a recess 314 positioned on the lower side of the erecting surface 312. The erecting surface 312 is positioned opposite to the second wall 306. The recess 314 is recessed toward the one side. The recess 314 forms (includes) a downward-facing surface 316 that faces downward. The downward-facing surface 316 faces the bottom portion 308.

The second wall 306 includes an erecting surface 320 that faces the one side and an upward-facing surface 322 that is positioned on the upper side of the erecting surface 320. The erecting surface 320 is positioned opposite to the first wall 304. The upward-facing surface 322 extends further toward the other side than the erecting surface 320.

Figure 6:
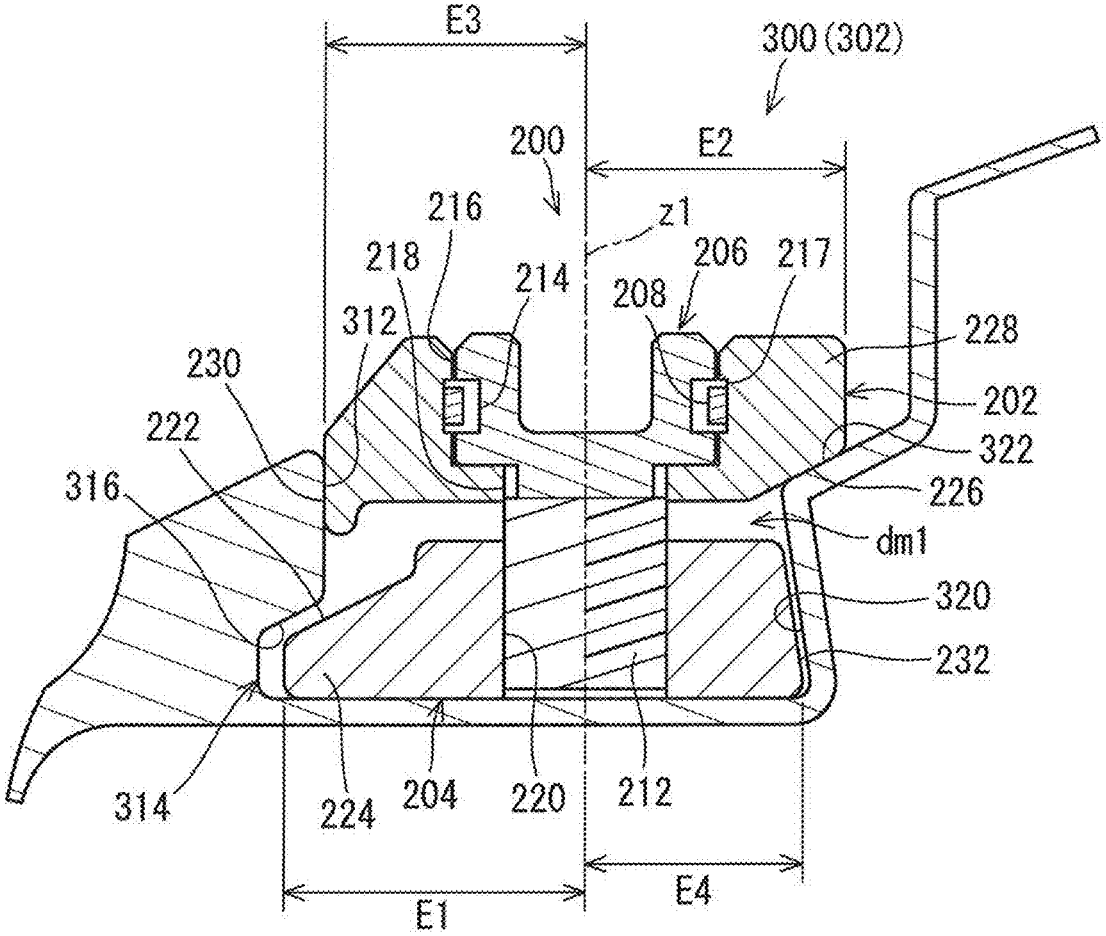
FIG. 6 is a cross-sectional view taken along line B-B in FIG. 1, and shows an unfixed state.
Figure 6:
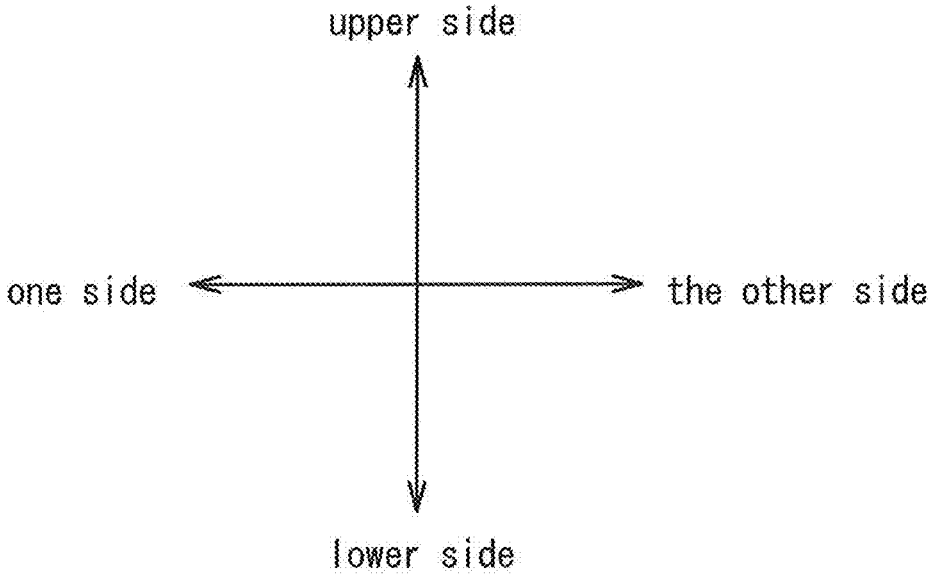
Figure 7:
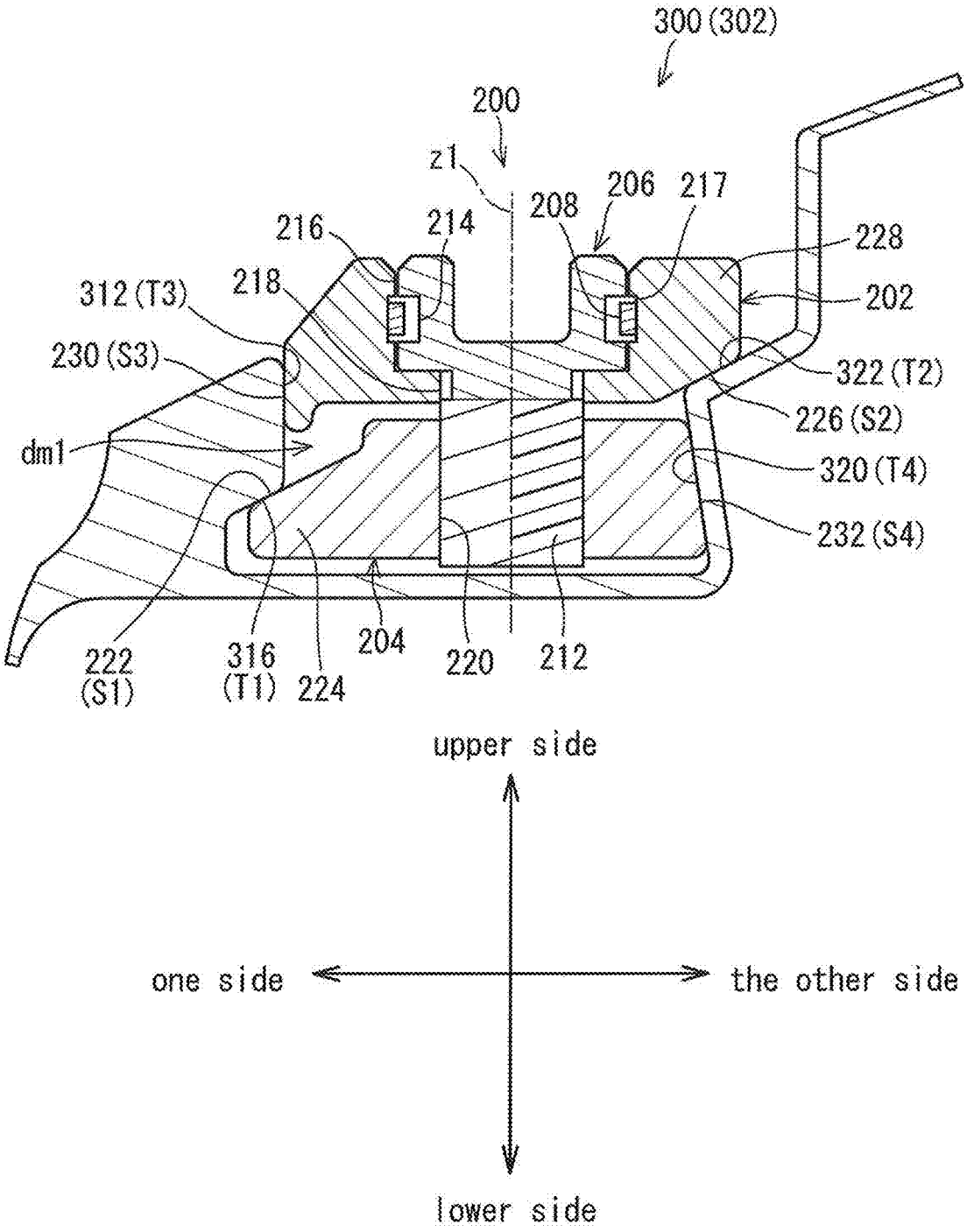
FIG. 7 is a cross-sectional view in which the embodiment of FIG. 6 has been shifted to a fixed state.

FIG. 6 and FIG. 7 show cross-sectional views of the weight object receiving portion 300 on which the weight object 200 is disposed. FIG. 6 shows the unfixed state. FIG. 7 shows the fixed state.

The outer member 202 has a head portion housing hole 216, and a through hole 218 that is coaxial with and connected to the head portion housing hole 216. The outer member 202 allows the screw portion 212 to penetrate through the outer member while retaining the head portion 210 of the coupling member 206. The washer 208 is fitted on a circumferential groove 217 that is provided on the inner circumferential surface of the head portion housing hole 216 of the outer member 202. Engagement between the washer 208 and the circumferential groove 214 prevents the coupling member 206 from falling out of the outer member 202. The outer member 202 retains the coupling member 206 such that the coupling member 206 can be rotated.

The inner member 204 includes a female screw hole 220. The female screw hole 220 penetrates through the inner member 204. The screw portion 212 is screw-connected to the female screw hole 220. The relative positional relationship between the outer member 202 and the inner member 204 can be changed by rotating the coupling member 206. This changes the shape of the weight object 200. The weight object 200 has a shape change mechanism dm1 that enables the weight object 200 to change a shape of itself.

As shown in FIG. 6, when the weight object 200 is in the unfixed state, the distance between the outer member 202 and the inner member 204 is relatively long. As shown in FIG. 7, when the weight object 200 is in the fixed state, the distance between the outer member 202 and the inner member 204 is relatively short. The fixed state is achieved by rotating the coupling member 206 and bringing the outer member 202 and the inner member 204 closer to each other.

The inner member 204 includes an upward-facing surface 222 on the one side thereof. The inner member 204 includes an extending portion 224 that is inserted into the recess 314 of the weight object receiving portion 300. The extending portion 224 is the one-side end part of the inner member 204. The extending portion 224 includes a part that extends further toward the one side than the one-side end of the outer member 202. The upward-facing surface 222 is the upper surface of the extending portion 224. When the weight object 200 is in the unfixed state (FIG. 6), the upward-facing surface 222 is disposed at a position facing the downward-facing surface 316.

The outer member 202 includes a downward-facing surface 226 on the other side thereof. The outer member 202 includes an extending portion 228 that extends on the upper side of the upward-facing surface 322. The extending portion 228 is the other-side end part of the outer member 202. The extending portion 228 includes a part that extends further toward the other side than the other-side end of the inner member 204. The downward-facing surface 226 is the lower surface of the extending portion 228. When the weight object 200 is in the unfixed state (FIG. 6), the downward-facing surface 226 is disposed at a position facing the upward-facing surface 322.

The outer member 202 includes an erecting surface 230 on the one side thereof. The erecting surface 230 is a surface that faces the one side. The erecting surface 230 is the one-side end surface of the outer member 202. When the weight object 200 is in the unfixed state (FIG. 6), the erecting surface 230 is disposed at a position facing the erecting surface 312.

The inner member 204 includes an erecting surface 232 on the other side thereof. The erecting surface 232 is a surface that faces the other side. The erecting surface 232 is the other-side end surface of the inner member 204. When the weight object 200 is in the unfixed state (FIG. 6), the erecting surface 232 is disposed at a position facing the erecting surface 320.

A double-pointed arrow E1 in FIG. 6 shows a length from the one-side end of the inner member 204 to the rotational center line z1. A double-pointed arrow E2 in FIG. 6 shows a length from the other-side end of the outer member 202 to the rotational center line z1. A double-pointed arrow E3 in FIG. 6 shows a length from the one-side end of the outer member 202 to the rotational center line z1. A double-pointed arrow E4 in FIG. 6 shows a length from the other-side end of the inner member 204 to the rotational center line z1. The length E1 to the length E4 are measured in a direction that is perpendicular to the rotational center line z1. The length E1 is longer than the length E3. The length E2 is longer than the length E4. The length E1 is longer than the length E4. The length E2 is longer than the length E3.

When the weight object 200 is in the unfixed state, a small gap is present between the weight object 200 and the weight object receiving portion 300. When it is difficult to insert the weight object 200 into the weight object receiving portion 300, a user can increase the distance between the outer member 202 and the inner member 204, or can separate the outer member 202 from the inner member 204 to insert the inner member 204 first into the weight object receiving portion 300. When once the weight object 200 is inserted into the weight object receiving portion 300, the weight object 200 can be a state where it does not fall out of the weight object receiving portion 300 even when it is in the unfixed state. As shown in FIG. 6, when the weight object 200 is in the unfixed state, the downward-facing surface 226 abuts against the upward-facing surface 322 and the erecting surface 230 abuts against the erecting surface 312 because of the gravity force acting on the weight object 200. The upward-facing surface 222 is located close to the downward-facing surface 316, and the erecting surface 232 is located close to the erecting surface 320.

As described above, the weight object 200 is disposed in the weight object receiving portion 300 with the weight object 200 being in the unfixed state. When the weight object 200 is in the unfixed state, the shape change mechanism dm1 is activated. In the present embodiment, the shape change mechanism dm1 is activated by rotating the coupling member 206 (by turning the screw). The outer member 202 and the inner member 204 come closer to each other by rotating the coupling member 206. This moves the inner member 204 upward, brings the upward-facing surface 222 into contact with the downward-facing surface 316, and brings the erecting surface 232 into contact with the erecting surface 320, whereby the weight object 200 comes into contact with the weight object receiving portion 300 at four positions in total at the same time. As the coupling member 206 is further tightened, contact pressures at the contact positions increase, and forces applied to the weight object 200 from the weight object receiving portion 300 at the contact positions are balanced, which brings about the fixed state of the weight object 200. For a shift from the fixed state to the unfixed state, the coupling member 206 is rotated in the opposite direction to increase the distance between the outer member 202 and the inner member 204.

By loosening the coupling member 206 when the weight object 200 is in the fixed state, the inner member 204 is separated apart from the outer member 202, whereby the weight object 200 is shifted to the unfixed state. Tightening of the coupling member 206 causes the weight object 200 to shift from the unfixed state to the fixed state. When the weight object 200 is disposed in the weight object receiving portion 300, the weight object 200 can be shifted between the fixed state and the unfixed state.

When the weight object 200 is in the fixed state (FIG. 7), the weight object 200 is in contact with the weight object receiving portion 300 at four positions. The four contact positions on the weight object 200 are referred to as a first contact part S1, a second contact part S2, a third contact part S3, and a fourth contact part S4. The four contact positions on the weight object receiving portion 300 are referred to as a first abutment part T1, a second abutment part T2, a third abutment part T3, and a fourth abutment part T4.

In the preset embodiment, the first contact part S1 is located on the upward-facing surface 222, the second contact part S2 is located on the downward-facing surface 226, the third contact part S3 is located on the erecting surface 230, and the fourth contact part S4 is located on the erecting surface 232. In the present embodiment, the first abutment part T1 is located on the downward-facing surface 316, the second abutment part T2 is located on the upward-facing surface 322, the third abutment part T3 is located on the erecting surface 312, and the fourth abutment part T4 is located on the erecting surface 320.

The first contact part S1 (first abutment part T1) is positioned on the one side with respect to the coupling member 206. The second contact part S2 (second abutment part T2) is positioned on the other side with respect to the coupling member 206. The third contact part S3 (third abutment part T3) is positioned on the one side with respect to the coupling member 206. The fourth contact part S4 (fourth abutment part T4) is positioned on the other side with respect to the coupling member 206. The first abutment part T1 (first contact part S1) is positioned on the lower side with respect to the third abutment part T3 (third contact part S3). The first abutment part T1 (first contact part S1) is positioned on the lower side with respect to the second abutment part T2 (second contact part S2). The fourth abutment part T4 (fourth contact part S4) is positioned on the lower side with respect to the second abutment part T2 (second contact part S2). The fourth abutment part T4 (fourth contact part S4) is positioned on the lower side with respect to the third abutment part T3 (third contact part S3).

The first abutment part T1 is located on the first wall 304 (see FIG. 5). The second abutment part T2 is located on the second wall 306 (see FIG. 5). The third abutment part T3 is located on the first wall 304. The fourth abutment part T4 is located on the second wall 306.

Figure 8A:
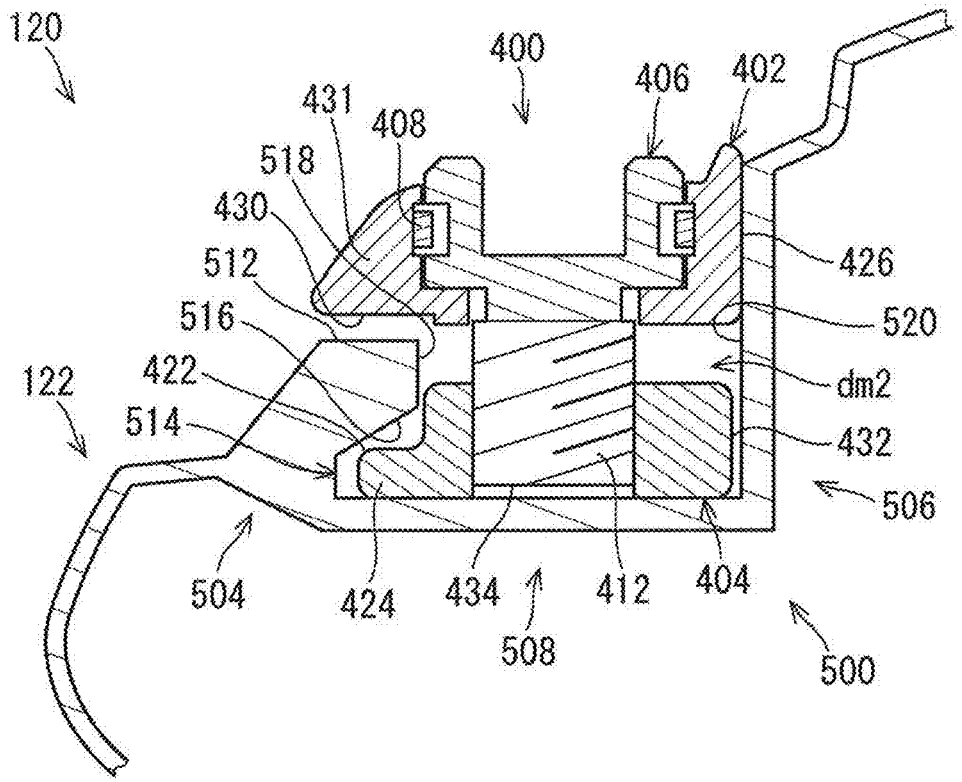
FIG. 8A and FIG. 8B are cross-sectional views of a weight object and a weight object receiving portion according to a second embodiment.
Figure 8B:
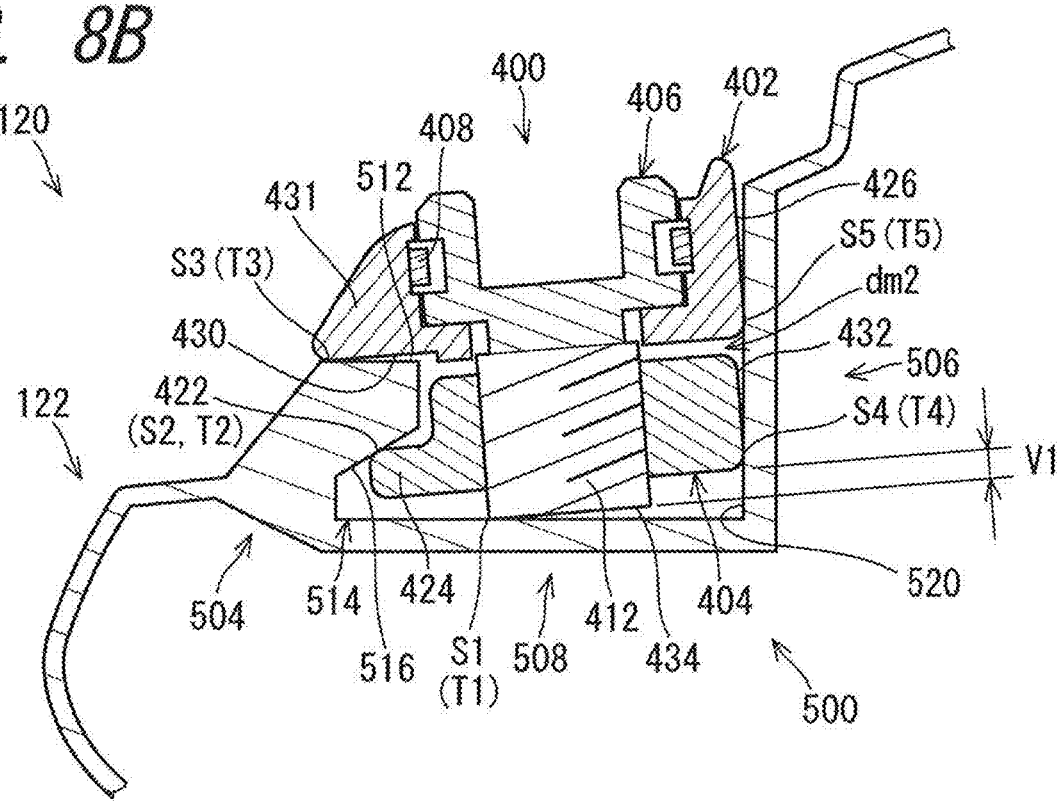

FIG. 8A and FIG. 8B show a cross-sectional view of a weight object and its vicinity of a head 120 according to a second embodiment. FIG. 8A shows the unfixed state. FIG. 8B shows the fixed state. The head 120 is the same as the head 100 except for the differences explained below.

The head 120 includes a weight object 400. The head 120 is constituted by the weight object 400 and the head body 122. The weight object 400 includes an outer member 402, an inner member 404, and a coupling member 406. The outer member 402 is positioned on the outer side of the head 120 relative to the inner member 404. The coupling member 406 connects the outer member 402 and the inner member 404. The coupling member 406 in the present embodiment is a screw. The weight object 400 further includes a washer 408. As with the above-described coupling member 206, the outer member 402 retains the coupling member 406 such that the coupling member 406 can be rotated. The inner member 404 is screw-connected to a screw portion 412 of the coupling member 406.

The head 120 (head body 122) includes a weight object receiving portion 500. The weight object receiving portion 500 includes a first wall 504 and a second wall 506. The second wall 506 is positioned opposite to the first wall 504. The first wall 504 is a wall on the one side. The second wall 506 is a wall on the other side. The weight object receiving portion 500 further includes a bottom portion 508. The bottom portion 508 connects the lower end of the first wall 504 and the lower end of the second wall 506.

The first wall 504 includes an upward-facing surface 512 that faces upward and a recess 514 that is positioned on the lower side of the upward-facing surface 512. The upward-facing surface 512 is an upper end surface of the first wall 504. The recess 514 is recessed toward the one side. The recess 514 forms (includes) a downward-facing surface 516 that faces downward. The downward-facing surface 516 is located on the lower side of the upward-facing surface 512. The downward-facing surface 516 faces the bottom portion 508. An erecting surface 518 is provided on the upper side of the downward-facing surface 516. The erecting surface 518 is positioned opposite to an erecting surface 520.

The second wall 506 includes the erecting surface 520 that faces the one side. The erecting surface 520 is positioned opposite to the first wall 504. The erecting surface 520 is a flat surface.

The relative positional relationship between the outer member 402 and the inner member 404 is changed by rotating the coupling member 406. This changes the shape of the weight object 400. The weight object 400 has a shape change mechanism dm2 that enables the weight object 400 to change a shape of itself.

As shown in FIG. 8A, when the weight object 400 is in the unfixed state, the distance between the outer member 402 and the inner member 404 is relatively long. As shown in FIG. 8B, when the weight object 400 is in the fixed state, the distance between the outer member 402 and the inner member 404 is relatively short. The fixed state is achieved by rotating the coupling member 406 to bring the outer member 402 and the inner member 404 closer to each other and to cause the coupling member 406 to protrude downward from the inner member 404.

The inner member 404 includes a corner 422 on the one side thereof. The corner 422 is a corner that faces the one side and upper side. The corner 422 is rounded. The inner member 404 includes an extending portion 424 that is inserted into the recess 514 of the weight object receiving portion 500. The extending portion 424 is the one-side end part of the inner member 404. The corner 422 is the corner of the extending portion 424. When the weight object 400 is in the unfixed state (FIG. 8A), the corner 422 is disposed at a position facing the downward-facing surface 516.

The outer member 402 includes an erecting surface 426 on the other side thereof. The erecting surface 426 is a surface that faces the other side. The erecting surface 426 is the other-side end surface of the outer member 402. The erecting surface 426 is disposed at a position facing the erecting surface 520.

The outer member 402 includes a downward-facing surface 430 on the one side thereof. The downward-facing surface 430 is a surface that faces downward. The outer member 402 includes an extending portion 431 on the one side thereof. The extending portion 431 is the one-side end part of the outer member 402. The extending portion 431 includes a part that extends further toward the one side than the one-side end of the inner member 404. The downward-facing surface 430 is the lower surface of the extending portion 431. When the weight object 400 is in the unfixed state (FIG. 8A), the downward-facing surface 430 is disposed at a position facing the upward-facing surface 512. The erecting surface 520 extends from a position lower than the downward-facing surface 516 to a position upper than the upward-facing surface 512.

The inner member 404 includes an erecting surface 432 on the other side thereof. The erecting surface 432 is a surface that faces the other side. The erecting surface 432 is the other-side end surface of the inner member 404. When the weight object 400 is in the unfixed state (FIG. 8A), the erecting surface 432 is disposed at a position facing the erecting surface 520. The erecting surface 432 is located (slightly) on the one side with respect to the erecting surface 426 of the outer member 402.

The weight object 400 has a shape change mechanism dm2 that enables the weight object 400 to change a shape of itself. This shape change mechanism dm2 is a mechanism that can change a protruding length V1 that is a protruding length of the coupling member 406 from the inner member 404 while changing the relative positional relationship between the outer member 402 and the inner member 404.

The fixed state is achieved by activating the shape change mechanism dm2. When the coupling member 406 is rotated, the protruding length V1 is increased to bring a tip end 434 of the coupling member 406 into contact with the bottom portion 508, and the inner member 404 is moved upward to bring the corner 422 into contact with the downward-facing surface 516. Simultaneously with this, the lower end of the erecting surface 432 is brought into contact with a lower part of the erecting surface 520, the lower end of the erecting surface 426 is brought into contact with an upper part of the erecting surface 520, and the one-side end of the downward-facing surface 430 is brought into contact with the upward-facing surface 512. As the coupling member 406 is further tightened, contact pressures at the contact positions increase, and forces applied to the weight object 400 from the weight object receiving portion 500 at the contact positions are balanced, which brings about the fixed state.

In the present embodiment, (the one-side end of) the tip part 434 of the coupling member 406 is the first contact part S1, the corner 422 is the second contact part S2, the one-side end of the downward-facing surface 430 is the third contact part S3, the lower end of the erecting surface 432 is the fourth contact part S4, and the lower end of the erecting surface 426 is the fifth contact part S5. Of the bottom portion 508, a part that abuts against the first contact part S1 is the first abutment part T1. Of the downward-facing surface 516, a part that abuts against the second contact part S2 is the second abutment part T2. Of the upward-facing surface 512, a part that abuts against the third contact part S3 is the third abutment part T3. Of the erecting surface 520, a part that abuts against the fourth contact part S4 is the fourth abutment part T4. Of the erecting surface 520, a part that abuts against the fifth contact part S5 is the fifth abutment part T5.

Unlike other embodiments, in the present embodiment, the number of contact parts when the weight object 400 is in the fixed state is five. The weight object 400 can abut against the weight object receiving portion 500 at five or more positions by adjusting dimensions of the weight object 400 and the weight object receiving portion 500. The fifth abutment part T5 contributes to stopping the rotation of the weight object 400. The fifth contact part S5 and the fifth abutment part T5 do not have to be present.

Figure 9A:
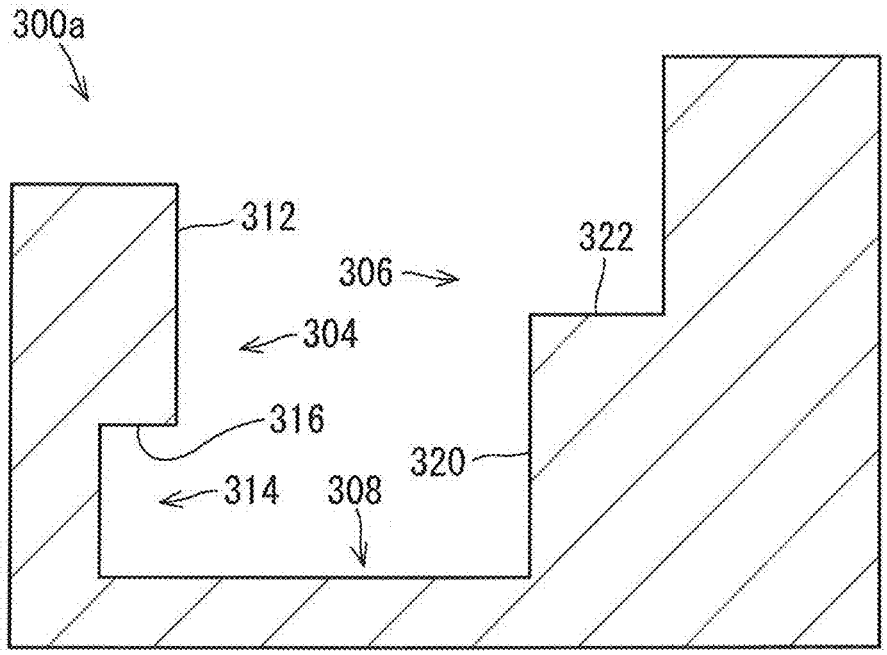
FIG. 9A is a cross-sectional view of a weight object receiving portion according to a modification example.

FIG. 9A shows a weight object receiving portion 300*a* according to a modification example. The weight object receiving portion 300*a* is made by simplifying the shape of the above-described weight object receiving portion 300. Accordingly, the basic structure of the weight object receiving portion 300*a* is the same as that of the weight object receiving portion 300. For this reason, the weight object receiving portion 300*a* is shown with the same reference symbols as in the weight object receiving portion 300.

As shown in FIG. 9A, the weight object receiving portion 300*a* includes a first wall 304 and a second wall 306. The second wall 306 is positioned opposite to the first wall 304. The first wall 304 is a wall on the one side. The second wall 306 is a wall on the other side. The weight object receiving portion 300*a* also includes a bottom portion 308. The bottom portion 308 connects the lower end of the first wall 304 and the lower end of the second wall 306.

The first wall 304 includes an erecting surface 312 that faces the other side, and a recess 314 that is positioned on the lower side of the erecting surface 312. The erecting surface 312 is positioned opposite to the second wall 306. The recess 314 is recessed toward the one side. The recess 314 forms (includes) a downward-facing surface 316 that faces downward. The downward-facing surface 316 faces the bottom portion 308.

The second wall 306 includes an erecting surface 320 that faces the one side and an upward-facing surface 322 that is positioned on the upper side of the erecting surface 320. The erecting surface 320 is positioned opposite to the first wall 304. The upward-facing surface 322 extends further toward the other side than the erecting surface 320.

Figure 9B:
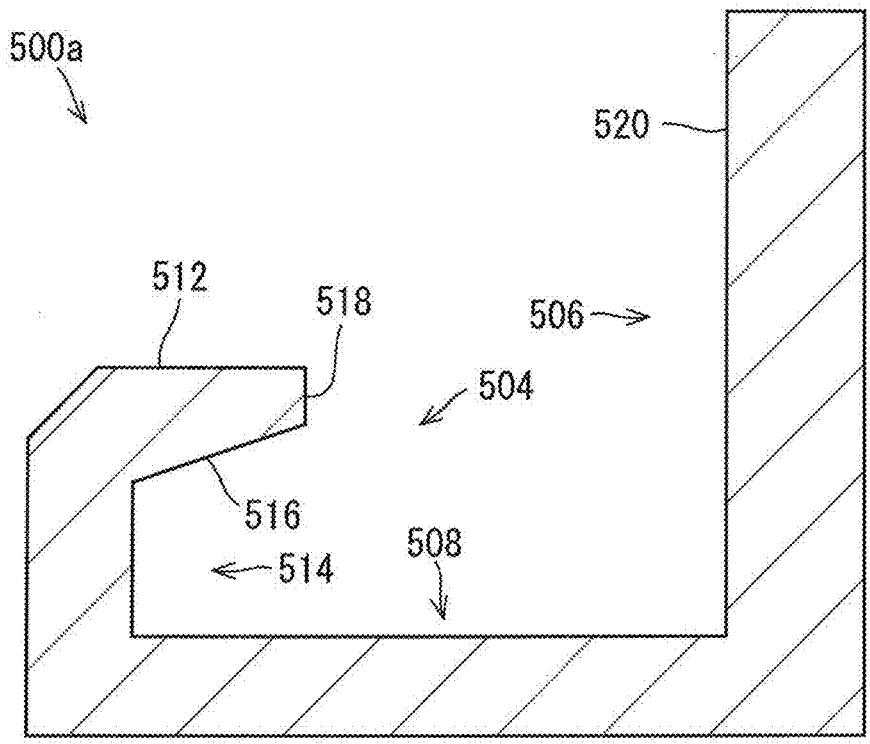
FIG. 9B is a cross-sectional view of a weight object receiving portion according to another modification example.

FIG. 9B shows a weight object receiving portion 500*a* according to another modification example. The weight object receiving portion 500*a* is made by simplifying the shape of the above-described weight object receiving portion 500. Accordingly, the basic structure of the weight object receiving portion 500*a* is the same as that of the weight object receiving portion 500. For this reason, the weight object receiving portion 500*a* is shown with the same reference symbols as in the weight object receiving portion 500.

The weight object receiving portion 500*a* includes a first wall 504 and a second wall 506. The second wall 506 is positioned opposite to the first wall 504. The first wall 504 is a wall on the one side. The second wall 506 is a wall on the other side. The weight object receiving portion 500*a* also includes a bottom portion 508. The bottom portion 508 connects the lower end of the first wall 504 and the lower end of the second wall 506.

The first wall 504 includes an upward-facing surface 512 that faces upward and a recess 514 that is positioned on the lower side of the upward-facing surface 512. The upward-facing surface 512 is the upper end surface of the first wall 504. The recess 514 is recessed toward the one side. The recess 514 forms (includes) a downward-facing surface 516 that faces downward. The downward-facing surface 516 faces the bottom portion 508.

The second wall 506 includes an erecting surface 520 that faces the one side. The erecting surface 520 is positioned opposite to the first wall 504. The erecting surface 520 is a flat surface.

Figure 10A:
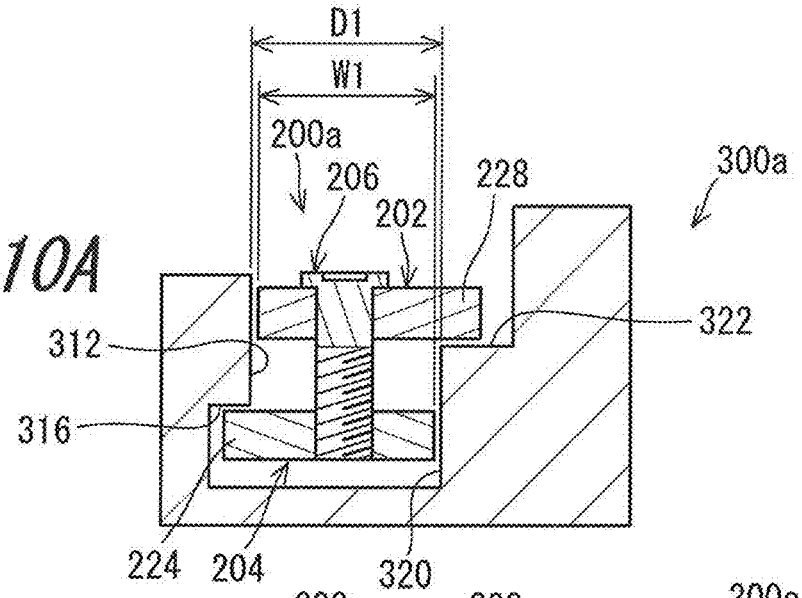
FIG. 10A to FIG. 10D show a weight object and a weight object receiving portion according to a third embodiment.
Figure 10B:
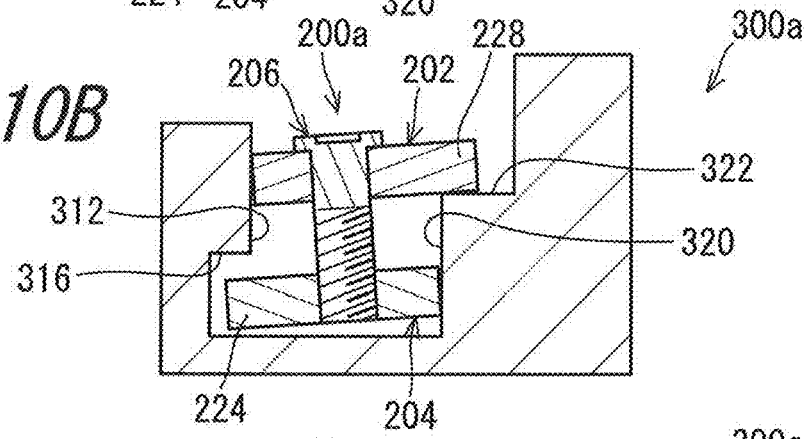
Figure 10C:
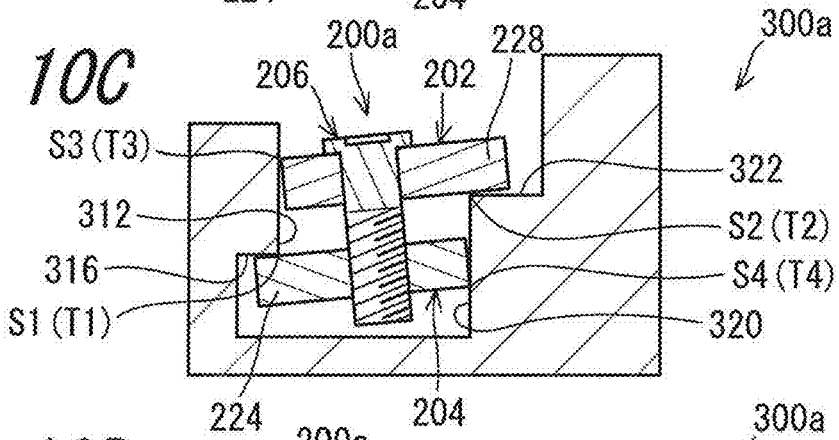
Figure 10D:
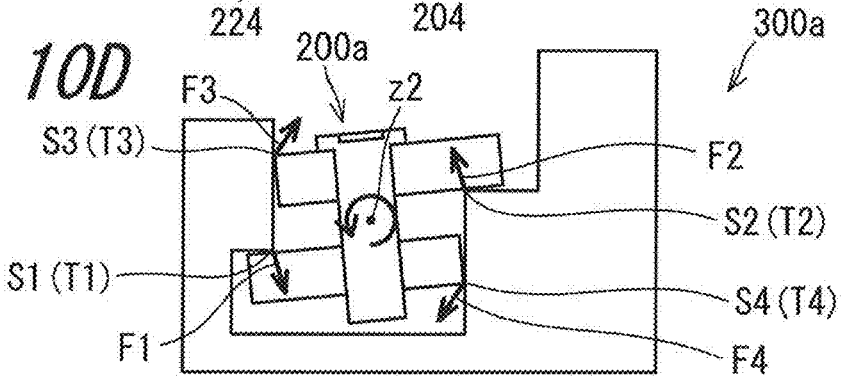

FIG. 10A to FIG. 10D show a weight object 200*a* and a weight object receiving portion 300*a* according to a third embodiment. FIG. 10A shows a dimensional relationship between the weight object 200*a* and the weight object receiving portion 300*a*. FIG. 10B shows the unfixed state. FIG. 10C shows the fixed state. FIG. 10D shows forces that act on the weight object 200*a* when the weight object 200*a* is in the fixed state. Hatchings are omitted from FIG. 10D.

The weight object receiving portion 300*a* is as described above. The weight object 200*a* is made by simplifying the shape of the above-described weight object 200. Accordingly, the basic structure of the weight object 200*a* is the same as that of the weight object 200. For this reason, the weight object 200*a* is shown with the same reference symbols as in the weight object 200.

The weight object 200*a* includes an outer member 202, an inner member 204 and a coupling member 206. The outer member 202 retains the coupling member 206 such that the coupling member 206 can be rotated. The inner member 204 is screw-connected to the screw portion of the coupling member 206. The outer member 202 includes an extending portion 228 that extends further toward the other side than the other-side end of the inner member 204. The extending portion 228 is disposed at a position facing the upward-facing surface 322. The inner member 204 includes an extending portion 224 that extends further toward the one side than the one-side end of the outer member 202. The extending portion 224 is disposed at a position facing the downward-facing surface 316.

When the weight object 200*a* is in the unfixed state as shown in FIG. 10B, the weight object 200*a* is retained in the weight object receiving portion 300*a* in a state where the weight object 200*a* abuts against the weight object receiving portion 300*a* at three positions under the influence of gravity.

When the coupling member 206 is rotated to bring the inner member 204 and the outer member 202 closer to each other, the extending portion 224 is brought into contact with the downward-facing surface 316. When the coupling member 206 is further tightened, the extending portion 224 is pressed against the downward-facing surface 316 and the extending portion 228 is pressed against the upward-facing surface 322 by the axial force of the coupling member 206. As a result, a rotational force is applied to the weight object 200*a*. This rotational force presses the one-side end of the outer member 202 against the erecting surface 312 and presses the other-side end of the inner member 204 against the erecting surface 320. Thus, the first abutment part T1 and the second abutment part T2 apply the rotational force to the weight object 200*a*. The rotational force is received at the third abutment part T3 and the fourth abutment part T4 and this state is maintained, whereby the weight object 200*a* is fixed.

Four contact positions on the weight object 200*a* in the fixed state are referred to as a first contact part S1, a second contact part S2, a third contact part S3, and a fourth contact part S4. The rotational force is applied to the first contact part S1 and the second contact part S2, and the rotation of the weight object 200*a* is prevented at the third contact part S3 and the fourth contact part S4. The first contact part S1 is located on the one side of the inner member 204. The first contact part S1 is a part that abuts against (the edge of) the downward-facing surface 316. The second contact part S2 is located on the other side of the outer member 202. The second contact part S2 is a part that abuts against (the edge of) the upward-facing surface 322. The third contact part S3 is located on the one side of the outer member 202. The third contact part S3 is a part that abuts against the erecting surface 312. The fourth contact part S4 is located on the other side of the inner member 204. The fourth contact part S4 is a part that abuts against the erecting surface 320.

The first contact part S1 and the third contact part S3 are located on the one side. The erecting surface 312 which is a flat surface extends between the first contact part S1 and the third contact part S3. The weight object receiving portion 300*a* is not present between the first contact part S1 and the third contact part S3.

The second contact part S2 and the fourth contact part S4 are located on the other side. The erecting surface 320 which is a flat surface extends between the second contact part S2 and the fourth contact part S4. The weight object receiving portion 300*a* is not present between the second contact part S2 and the fourth contact part S4.

A double-pointed arrow D1 in FIG. 10A shows a distance (shortest distance) between the erecting surface 320 and the erecting surface 312. A double-pointed arrow W1 in FIG. 10A shows a width between the one-side end of the outer member 202 and the other-side end of the inner member 204.

This width W1 is measured in a direction that is perpendicular to the rotational center line of the coupling member 206. In the present embodiment, the width W1 is smaller than the distance D1. As a result, the weight object 200*a* is fixed in a state of being inclined toward the one side.

Figure 11A:
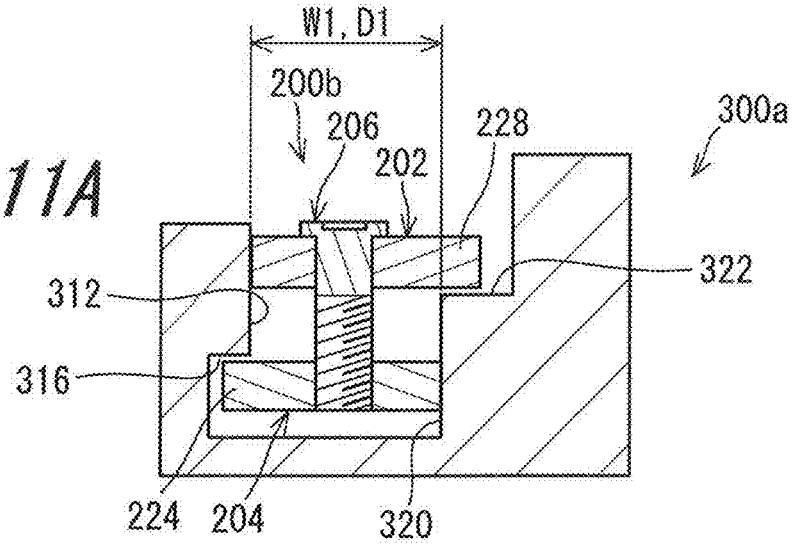
FIG. 11A to FIG. 11D show a weight object and a weight object receiving portion according to a fourth embodiment.
Figure 11B:
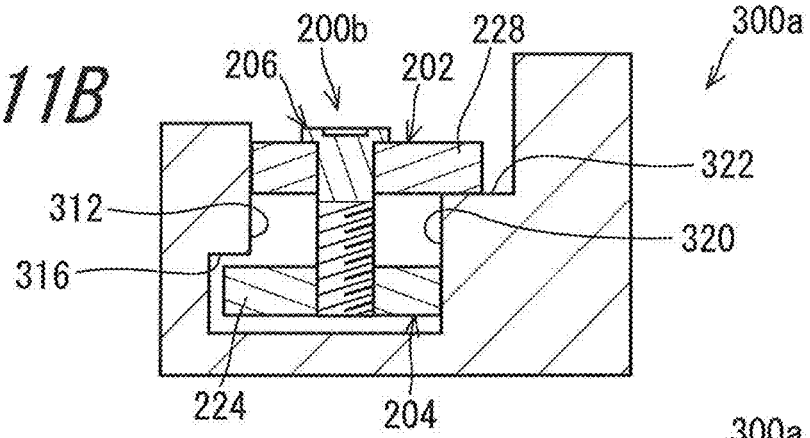
Figure 11C:
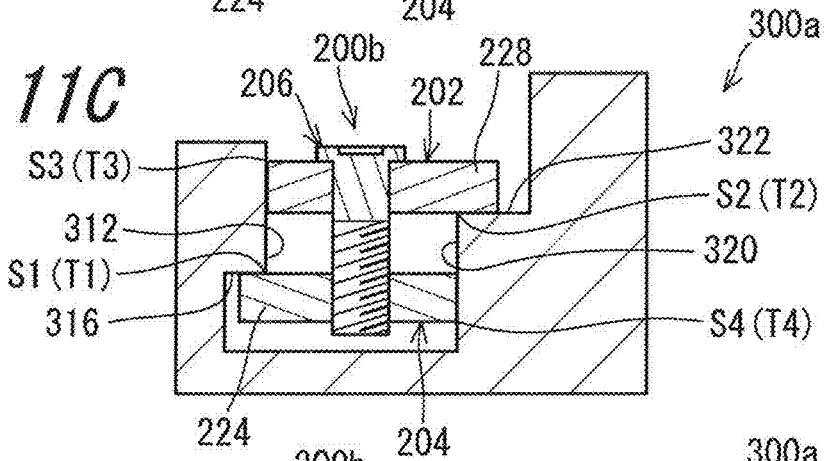
Figure 11D:
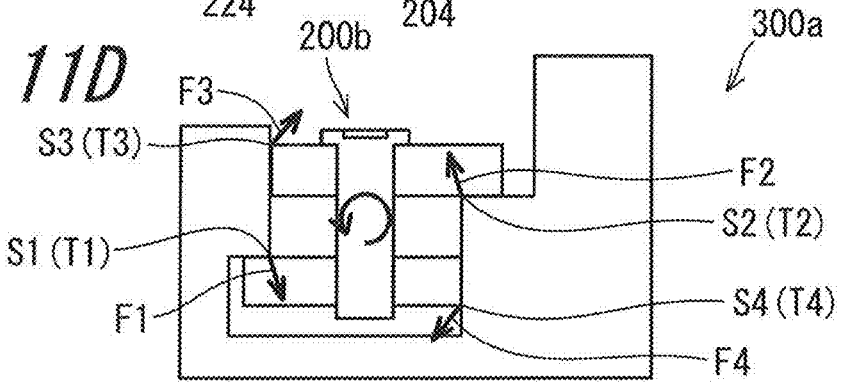

FIG. 11A to FIG. 11D show a weight object 200*b* and a weight object receiving portion 300*a* according to a fourth embodiment. FIG. 11A shows a dimensional relationship between the weight object 200*b* and the weight object receiving portion 300*a*. FIG. 11B shows the unfixed state. FIG. 11C shows the fixed state. FIG. 11D shows forces that act on the weight object 200*b* when the weight object 200*b* is in the fixed state. Hatchings are omitted from FIG. 11D.

In the fourth embodiment, the weight object receiving portion 300*a* is the same as that of the third embodiment, and only the weight object 200*b* is different from the third embodiment. The width W1 of the weight object 200*b* is equal to the distance D1. As a result, the weight object 200*b* is fixed without being inclined.

As shown in FIG. 11C, when the weight object 200*b* is in the fixed state, the weight object 200*b* is brought into surface-to-surface contact with the weight object receiving portion 300*a* at all contact positions. As shown in FIG. 11D, however, positions at which stress is concentrated are the same as the contact positions in the third embodiment shown in FIG. 10D. In the present embodiment, the positions where stress is concentrated can be considered as contact parts S1 to S4 and abutment parts T1 to T4.

The arrangement of the first contact part S1 to the fourth contact part S4 remains the same in this embodiment. The first contact part S1 is located on the one side of the inner member 204. The second contact part S2 is located on the other side of the outer member 202. The third contact part S3 is located on the one side of the outer member 202. The fourth contact part S4 is located on the other side of the inner member 204. Also in the present embodiment, the rotational force is applied to the first contact part S1 and the second contact part S2, and the rotation of the weight object 200*b* is prevented at the third contact part S3 and the fourth contact part S4. Thus, the first abutment part T1 and the second abutment part T2 apply the rotational force on the weight object 200*b*. The rotational force is received at the third abutment part T3 and the fourth abutment part T4, whereby the weight object 200*b* is fixed.

Figure 12A:
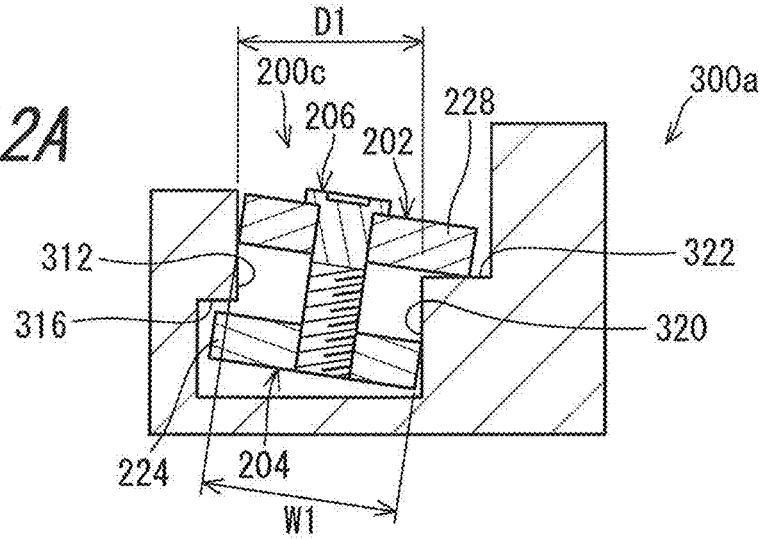
FIG. 12A to FIG. 12D show a weight object and a weight object receiving portion according to a fifth embodiment.
Figure 12B:
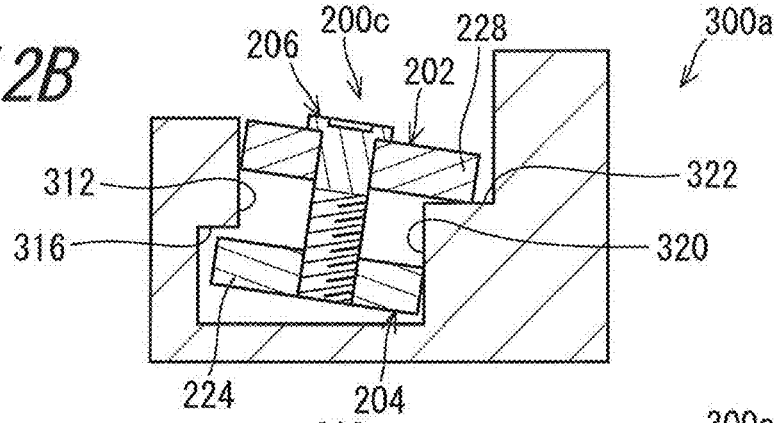
Figure 12C:
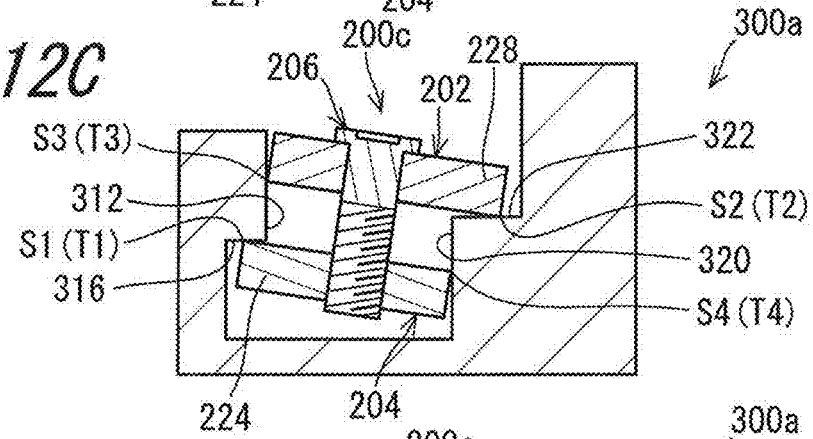
Figure 12D:
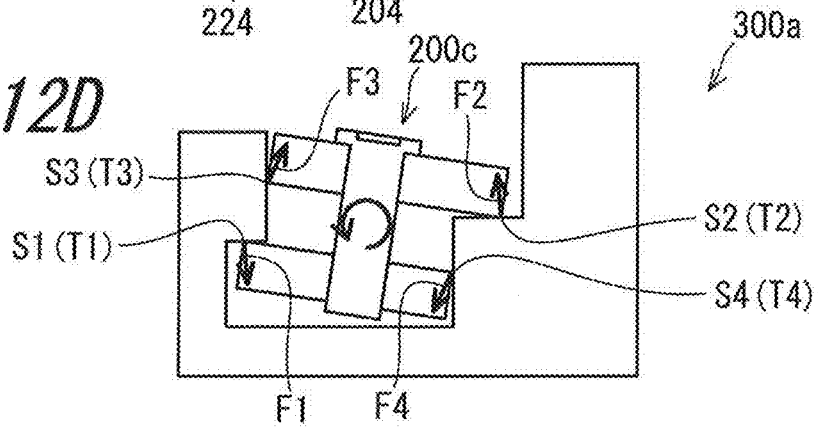

FIG. 12A to FIG. 12D show a weight object 200*c* and a weight object receiving portion 300*a* according to a fifth embodiment. FIG. 12A shows a dimensional relationship between the weight object 200*c* and the weight object receiving portion 300*a*. FIG. 12B shows the unfixed state. FIG. 12C shows the fixed state. FIG. 12D shows forces that act on the weight object 200*c* when the weight object 200*c* is in the fixed state. Hatchings are omitted from FIG. 12D.

In the fifth embodiment, the weight object receiving portion 300*a* is the same as that of the third embodiment, and only the weight object 200*c* is different from the third embodiment. The width W1 of the weight object 200*c* is greater than the distance D1. As a result, the weight object 200*c* is fixed in a state of being inclined toward the other side.

Since the orientation of the inclination of the weight object 200*c* is different from that of the weight object 200*a*, contact positions in the fixed state are slightly different from those of the third embodiment (FIG. 10C). The arrangement of the first contact part S1 to the fourth contact part S4, however, remains the same in this embodiment. The first contact part S1 is located on the one side of the inner member 204. The second contact part S2 is located on the other side of the outer member 202. The third contact part S3 is located on the one side of the outer member 202. The fourth contact part S4 is located on the other side of the inner member 204. Also in the present embodiment, the rotational force is applied to the first contact part S1 and the second contact part S2, and the rotation of the weight object 200*c* is prevented at the third contact part S3 and the fourth contact part S4. Thus, the rotational force is applied to the weight object 200*c* from the first abutment part T1 and the second abutment part T2. The rotational force is received by the third abutment part T3 and the fourth abutment part T4, whereby the weight object 200*c* is fixed.

Figure 13:
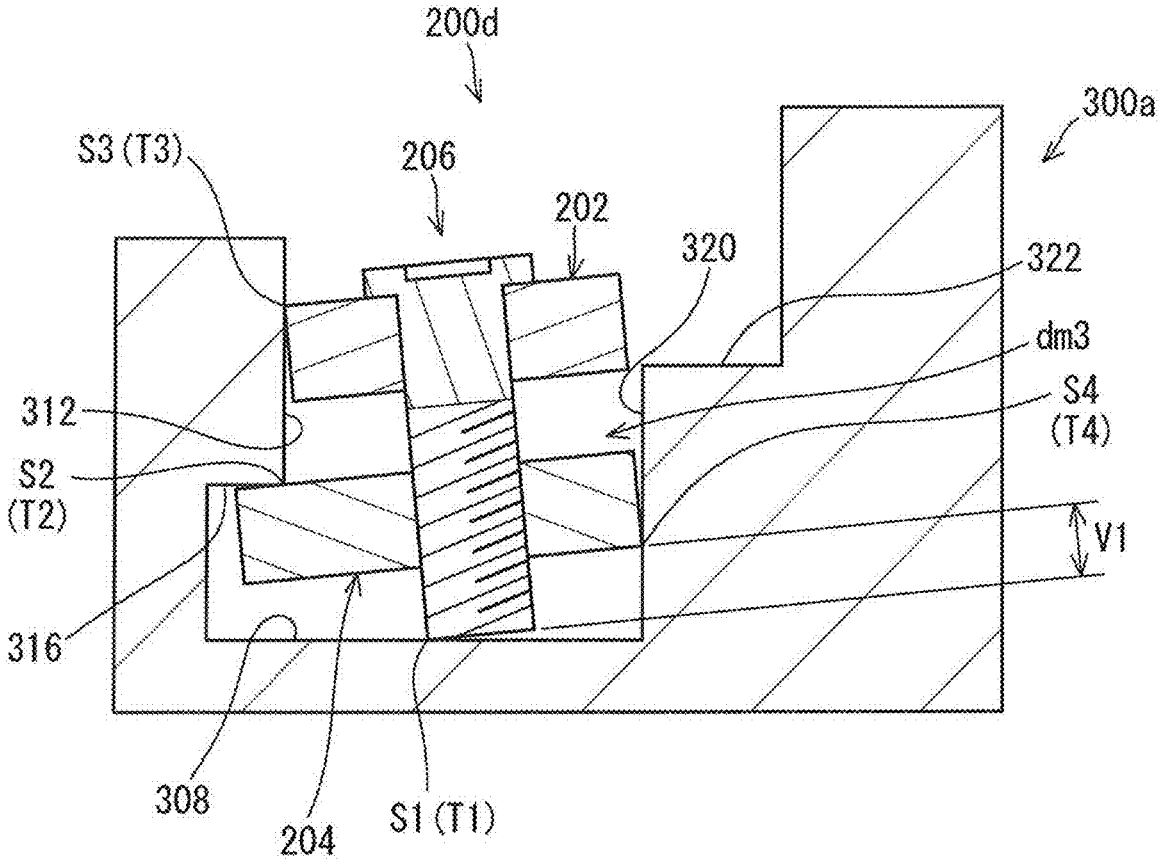
FIG. 13 is a cross-sectional view showing a weight object and a weight object receiving portion according to a sixth embodiment.

FIG. 13 shows a weight object 200*d* and a weight object receiving portion 300*a* according to a sixth embodiment. FIG. 13 shows the fixed state. The weight object receiving portion 300*a* is as described above with reference to FIG. 9A, and is the same as in the third to fifth embodiments. In the weight object 200*d*, the length of the other-side part of the outer member 202 is short. Unlike the weight objects 200*a* to 200*c*, when the weight object 200*d* is in the unfixed state, the weight object 200*d* may come down on the bottom portion 308 of the weight object receiving portion 300*a*. The rotation of the coupling member 206 changes the protruding length V1 of the coupling member 206 from the inner member 204. The weight object 200*d* has a shape change mechanism dm3 that changes the protruding length V1 of the coupling member 206 from the inner member 204 while changing the relative positional relationship between the outer member 202 and the inner member 204.

When the coupling member 206 is rotated, the inner member 204 moves upward and comes closer to the outer member 202, and the tip part of the coupling member 206 is brought into contact with the bottom portion 308. When the coupling member 206 is further tightened, the tip part of the coupling member 206 presses the bottom portion 308, and the one-side end part of the inner member 204 presses the edge of the downward-facing surface 316. A rotational force is applied to the weight object 200*d* as a reaction of these pressing forces. The direction of rotation of the weight object 200*d* which can be caused by the rotational force is the counterclockwise direction in FIG. 13 and is the same as those of the first to fifth embodiments. Positions to which the rotational force is applied are the first contact part S1 and the second contact part S2. Positions that apply the rotational force to the weight object 200*d* at the contact parts are the first abutment part T1 and the second abutment part T2. In the present embodiment, the tip part of the coupling member 206 is the first contact part S1. Of the bottom portion 308, a part that is in contact with the first contact part S1 is the first abutment part T1. Of the inner member 204, a part that abuts against the edge of the downward-facing surface 316 is the second contact part S2. The edge of the downward-facing surface 316 is the second abutment part T2.

The rotation of the weight object 200*d* caused by the rotational force is stopped by the erecting surface 320 and the erecting surface 312. The one-side end part of the outer member 202 comes into contact with the erecting surface 312. In this contact, a contact position of the weight object 200*d* is the third contact part S3 and a contact position of the weight object receiving portion 300*a* is the third abutment part T3. The other-side end of the inner member 204 comes into contact with the erecting surface 320. In this contact, a contact position of the weight object 200*d* is the fourth contact part S4 and a contact position of the weight object receiving portion 300*a* is the fourth abutment part T4. The rotation of the weight object 200*d* is prevented by the third abutment part T3 and the fourth abutment part T4. Thus, the rotational force is applied to the weight object 200*d* from the first abutment part T1 and the second abutment part T2. The rotational force is received by the third abutment part T3 and the fourth abutment part T4, whereby the weight object 200*d* is fixed.

In the present embodiment, when the weight object 200*d* is in the fixed state, the other-side end part of the outer member 202 does not abut on the weight object receiving portion 300*a*. The other-side end part of the outer member 202 does not play a part in fixation of the weight object 200*d*.

Figure 14:
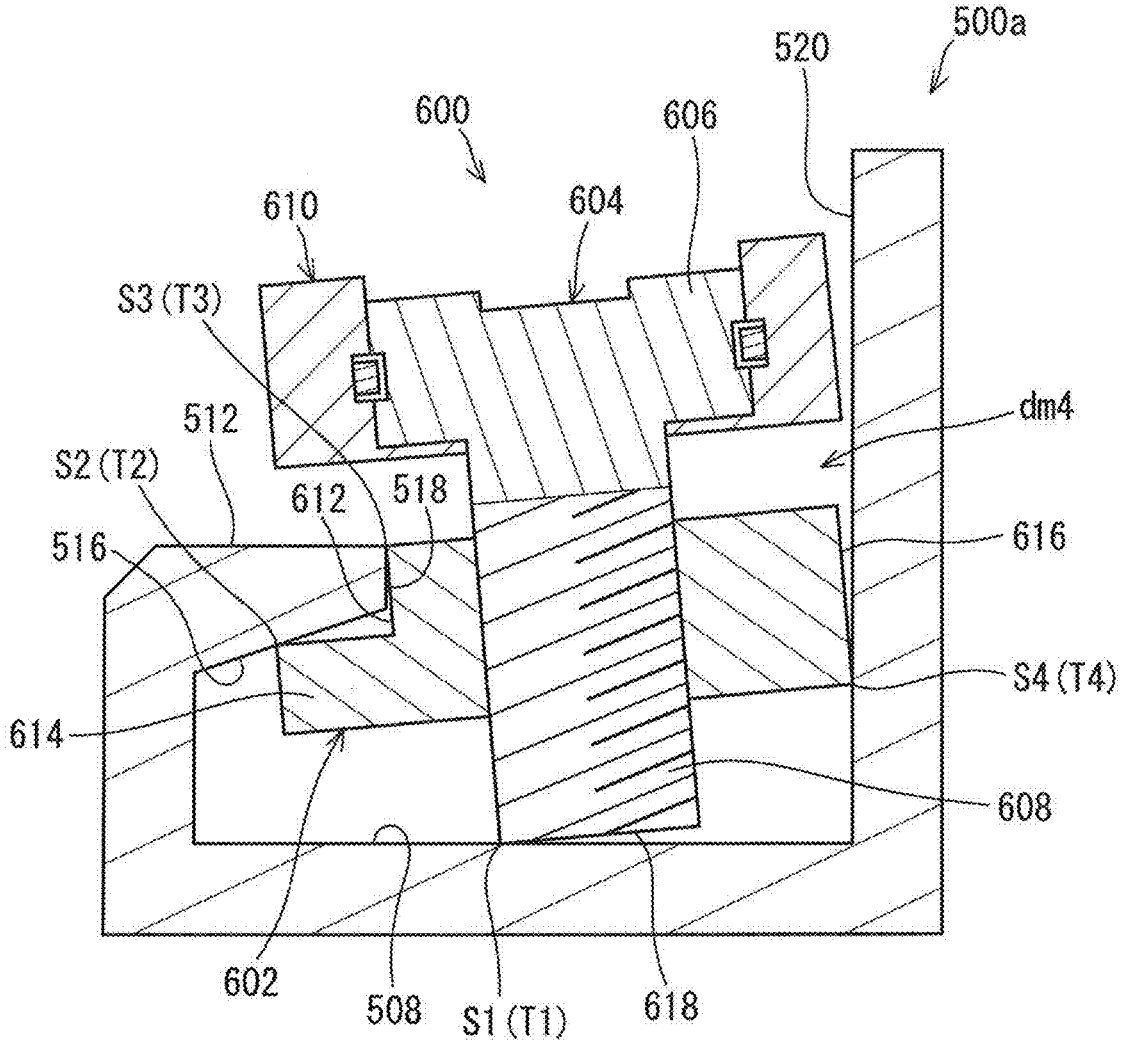
FIG. 14 is a cross-sectional view showing a weight object and a weight object receiving portion according to a seventh embodiment.

FIG. 14 is a cross-sectional view showing a weight object 600 and a weight object receiving portion 500*a* according to a seventh embodiment. FIG. 14 shows the fixed state.

Unlike the weight object 200 and the like, the weight object 600 does not include an outer member or an inner member. The weight object 600 includes a main member 602 and a connected member 604. In the present embodiment, the connected member 604 is a screw. The connected member 604 is movably connected to the main member 602. By rotating the connected member 604, the connected member 604 moves relative to the main member 602. The connected member 604 includes a head portion 606 and a male screw portion 608. The male screw portion 608 of the connected member 604 penetrates through the main member 602 while being screw-connected to the main member 602. The weight object 600 also includes a sub-member 610. The sub-member 610 is attached to the head portion 606.

The weight object receiving portion 500*a* is as described above with reference to FIG. 9B.

A one-side part of the main member 602 includes an erecting surface 612 and an extending portion 614 that is located on the lower side of the erecting surface 612 and that extends further toward the one side than the erecting surface 612. The erecting surface 612 is a surface that faces the one side. The extending portion 614 constitutes a one-side end part of the main member 602. The extending portion 614 is disposed at a position facing the downward-facing surface 516. The erecting surface 612 is disposed at a position facing the erecting surface 518. The other-side end part 616 of the main member 602 is disposed at a position facing the erecting surface 520.

The weight object 600 has a shape change mechanism dm4 that can change a protruding length of the connected member 604 from the main member 602. When the connected member 604 is rotated, the main member 602 moves upward and the extending portion 614 comes closer to the downward-facing surface 516 while a tip part 618 of the connected member 604 abuts against the bottom portion 508. As the connected member 604 is further tightened, the tip part 618 of the connected member 604 presses the bottom portion 508, and the extending portion 614 of the main member 602 comes into contact with and presses the downward-facing surface 516. A rotational force is applied to the weight object 600 as a reaction of these pressing forces. The direction of rotation of the weight object 600 which can be caused by the rotational force is the counterclockwise direction in FIG. 14. Positions to which the rotational force is applied are the first contact part S1 and the second contact part S2. Positions that apply the rotational force to the weight object 600 at the contact parts are the first abutment part T1 and the second abutment part T2. In the present embodiment, the first contact part S1 is located at the tip part 618 of the connected member 604. Of the bottom portion 508, a part on which the first contact part S1 abuts is the first abutment part T1. Of the extending portion 614, a corner that abuts against the downward-facing surface 516 is the second contact part S2. Of the downward-facing surface 516, a part that abuts against the second contact part S2 is the second abutment part T2.

The rotation of the weight object 600 caused by the rotational force is stopped by the erecting surface 520 and the erecting surface 518. The erecting surface 612 comes into contact with the erecting surface 518. In this contact, a contact position of the weight object 600 is the third contact part S3, and a contact position of the weight object receiving portion 500*a* is the third abutment part T3. The end part 616 comes into contact with the erecting surface 520. In this contact, a contact position of the weight object 600 is the fourth contact part S4, and a contact position of the weight object receiving portion 500*a* is the fourth abutment part T4. The rotation of the weight object 600 is prevented by the third abutment part T3 and the fourth abutment part T4. Thus, the first abutment part T1 and the second abutment part T2 apply the rotational force to the weight object 600, and the rotational force is received by the third abutment part T3 and the fourth abutment part T4. The weight object 600 is fixed in a state where these forces are balanced. The sub-member 610 does not play a part in fixation of the weight object 600.

Figure 15:
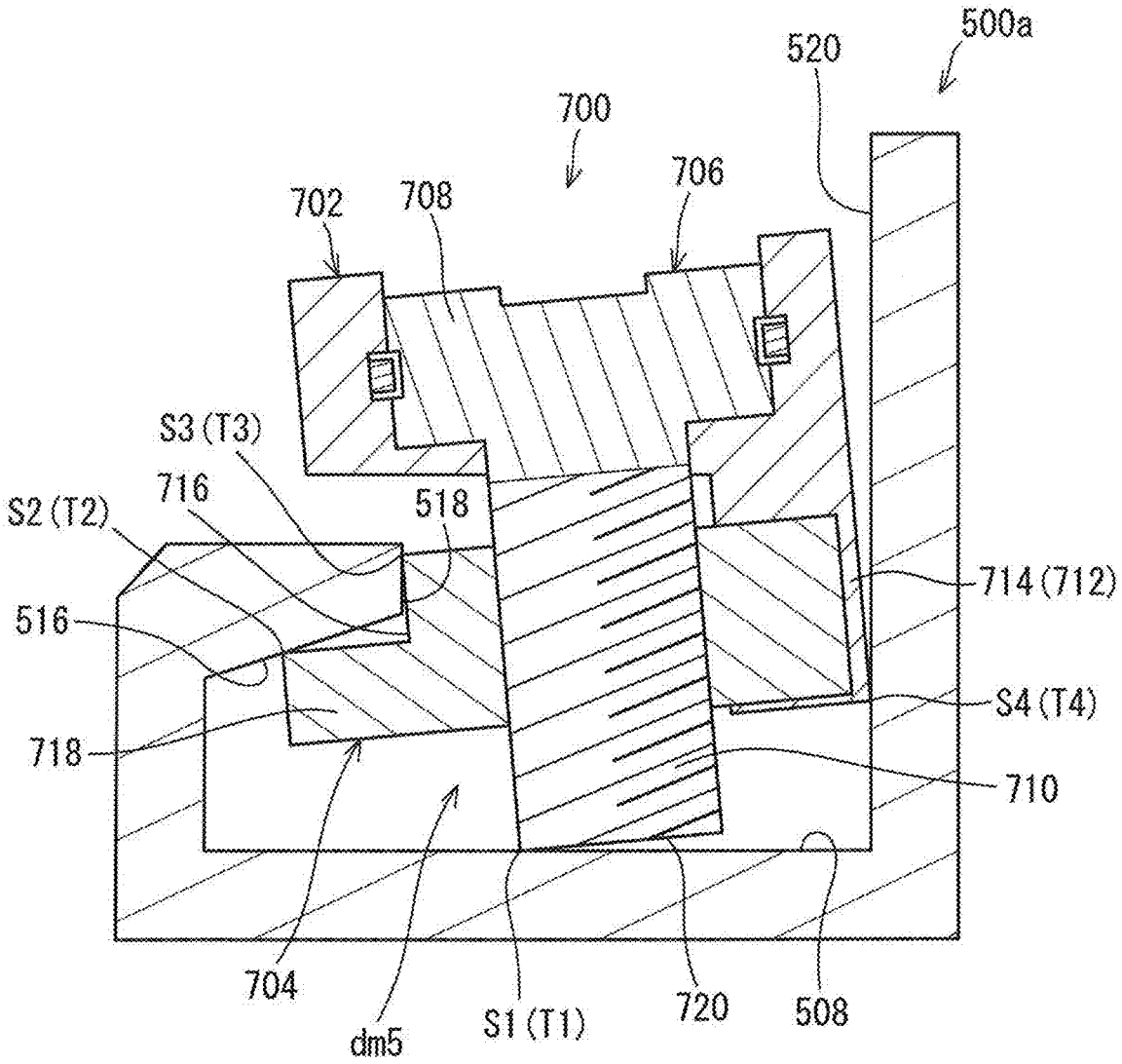
FIG. 15 is a cross-sectional view showing a weight object and a weight object receiving portion according to an eighth embodiment.

FIG. 15 is a cross-sectional view showing a weight object 700 and a weight object receiving portion 500*a* according to an eighth embodiment. FIG. 15 shows the fixed state.

The weight object 700 includes an outer member 702, an inner member 704, and a coupling member 706. The coupling member 706 in the present embodiment is a screw. The coupling member 706 connects the outer member 702 and the inner member 704. The coupling member 706 includes a head portion 708 and a male screw portion 710. The male screw portion 710 of the coupling member 706 penetrates through the inner member 704 while being screw-connected to the inner member 704. The outer member 702 retains the coupling member 706 such that the coupling member 706 can be rotated. By rotating the coupling member 706, the relative positional relationship between the outer member 702 and the inner member 704 changes, and a protruding length of the coupling member 706 from the inner member 704 changes.

The weight object receiving portion 500*a* is as described above with reference to FIG. 9B.

The outer member 702 includes a downward extending portion 712 on the other side thereof. The downward extending portion 712 includes a lower end part 714 that is located on the other side with respect to the other-side end of the inner member 704. The lower end part 714 is disposed at a position facing the erecting surface 520.

A one-side part of the inner member 704 includes an erecting surface 716 and an extending portion 718 that is located on the lower side of the erecting surface 716 and that extends further toward the one side than the erecting surface 716. The erecting surface 716 is a surface that faces the one side. The extending portion 718 constitutes a one-side end part of the inner member 704. The extending portion 718 is disposed at a position facing the downward-facing surface 516. The erecting surface 716 is disposed at a position facing the erecting surface 518.

The weight object 700 has a shape change mechanism dm5 that changes a protruding length of the coupling member 706 from the inner member 704 while changing the relative positional relationship between the outer member 702 and the inner member 704. When the coupling member 706 is rotated, the inner member 704 moves upward and the extending portion 718 comes closer to the downward-facing surface 516, while a tip part 720 of the coupling member 706 abuts against the bottom portion 508. As the coupling member 706 is further tightened, the tip part 720 presses the bottom portion 508, and the extending portion 718 comes into contact with and presses the downward-facing surface 516. A rotational force is applied to the weight object 700 as a reaction of these pressing forces. The direction of rotation of the weight object 700 which can be caused by the rotational force is the counterclockwise direction in FIG. 15. Positions to which the rotational force is applied are the first contact part S1 and the second contact part S2. Positions that apply the rotational force to the weight object 700 at the contact parts are the first abutment part T1 and the second abutment part T2. In the present embodiment, the first contact part S1 is located at the tip part 720 of the coupling member 706. Of the bottom portion 508, a part on which the first contact part S1 abuts is the first abutment part T1. Of the extending portion 718, a corner that abuts against the downward-facing surface 516 is the second contact part S2. Of the downward-facing surface 516, a part that abuts against the second contact part S2 is the second abutment part T2.

The rotation of the weight object 700 caused by the rotational force is stopped by the erecting surface 520 and the erecting surface 518. The erecting surface 716 comes into contact with the erecting surface 518. In this contact, a contact position of the weight object 700 is the third contact part S3, and a contact position of the weight object receiving portion 500*a* is the third abutment part T3. The lower end part 714 comes into contact with the erecting surface 520. In this contact, a contact position of the weight object 700 is the fourth contact part S4 and a contact position of the weight object receiving portion 500*a* is the fourth abutment part T4. The rotation of the weight object 700 is prevented by the third abutment part T3 and the fourth abutment part T4. Thus, the rotational force is applied to the weight object 700 from the first abutment part T1 and the second abutment part T2. The rotational force is received by the third abutment part T3 and the fourth abutment part T4, whereby the weight object 700 is fixed.

Figure 16A:
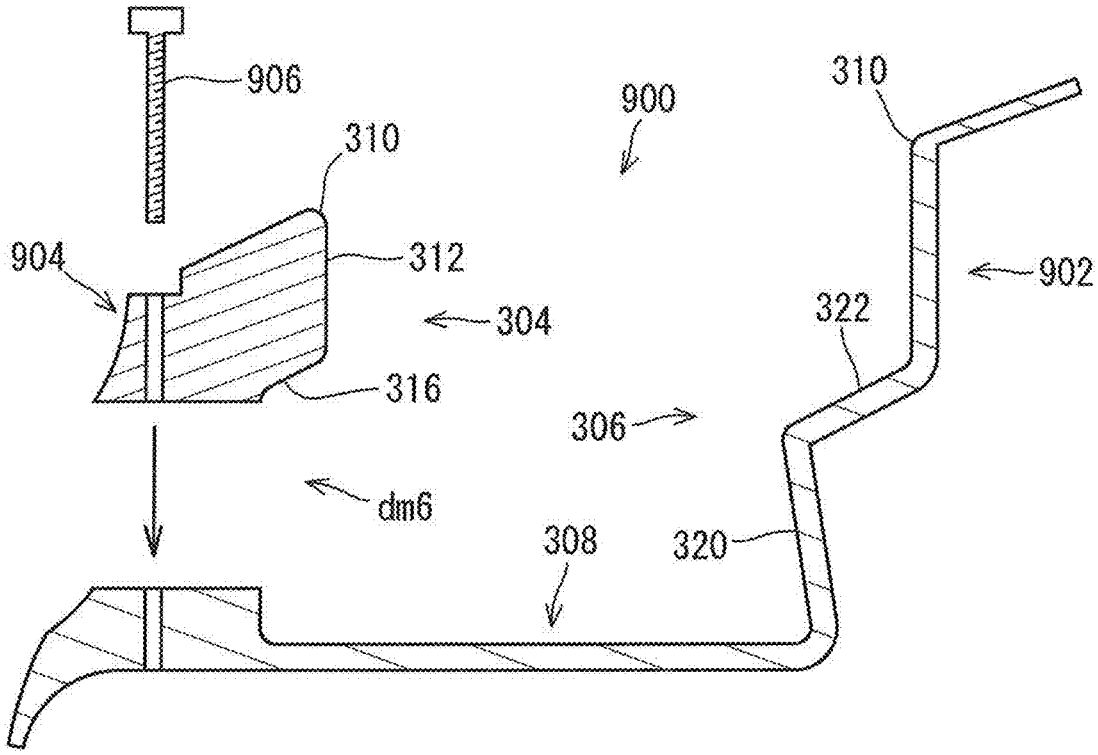
FIG. 16A is an exploded cross-sectional view of a weight object receiving portion according to a ninth embodiment.
Figure 16B:
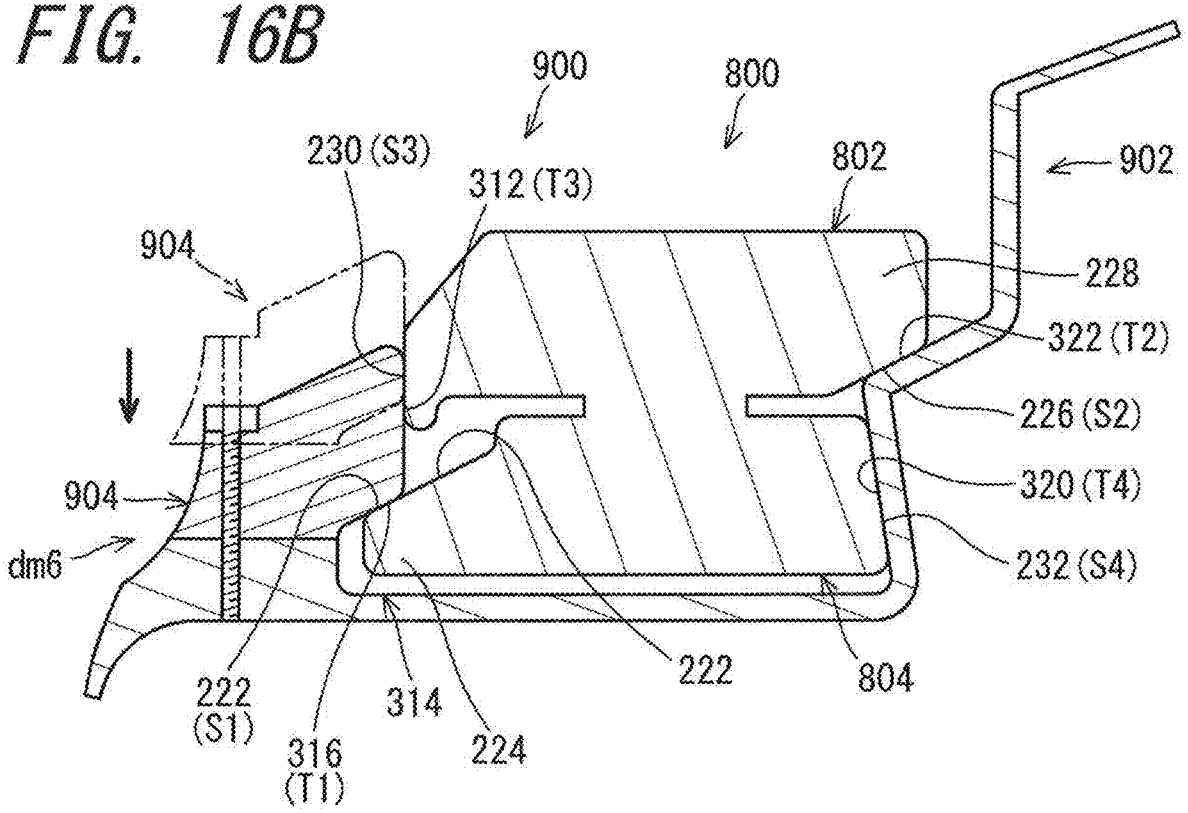
FIG. 16B is a cross-sectional view showing a weight object and the weight object receiving portion according to the ninth embodiment.

FIG. 16A and FIG. 16B are cross-sectional views showing a weight object 800 and a weight object receiving portion 900 according to a ninth embodiment. FIG. 16B shows the fixed state.

In the above-described first to eighth embodiments, their weight objects have respective shape change mechanisms. In contrast to those embodiments, the weight object receiving portion 900 has a shape change mechanism in the ninth embodiment.

The weight object receiving portion 900 includes a fixed part 902 and a movable part 904. The fixed part 902 is a part of the head body. The movable part 904 is detachably fixed to the fixed part 902. The movable part 904 moves during the process of attaching the movable part 904 to the fixed part 902 (see a virtual line and arrow in FIG. 16B). The movable part 904 is fixed to the fixed part 902 by a screw 906. The weight object receiving portion 900 moves with respect to the fixed part 902 when the movable part 904 is attached and detached. This movement changes the shape of the weight object receiving portion 900.

In a state where the movable part 904 is fixed, the shape of the weight object receiving portion 900 is the same as that of the above-described weight object receiving portion 300 (FIG. 5). For this reason, the weight object receiving portion 900 is shown with the same reference symbols as in the weight object receiving portion 300. The weight object receiving portion 900 includes a first wall 304 and a second wall 306. The second wall 306 is positioned opposite to the first wall 304. The first wall 304 is a wall on the one side. The second wall 306 is a wall on the other side. The weight object receiving portion 900 also includes a bottom portion 308. The bottom portion 308 connects the lower end of the first wall 304 and the lower end of the second wall 306. The upper end of the first wall 304 and the upper end of the second wall 306 are an opening edge 310 of the weight object receiving portion 900 (see FIG. 4). The first wall 304 includes an erecting surface 312 that faces the other side, and a recess 314 that is positioned on the lower side of the erecting surface 312. The erecting surface 312 is positioned opposite to the second wall 306. The recess 314 is recessed toward the one side. The recess 314 forms (includes) a downward-facing surface 316 that faces downward. The downward-facing surface 316 faces the bottom portion 308. The second wall 306 includes an erecting surface 320 that faces the one side and an upward-facing surface 322 that is positioned on the upper side of the erecting surface 320. The erecting surface 320 is positioned opposite to the first wall 304. The upward-facing surface 322 extends further toward the other side than the erecting surface 320.

The first wall 304 is formed by the movable part 904.

The weight object 800 includes an outer part 802 and an inner part 804. The weight object 800 does not have a shape change mechanism for changing its shape. Of the weight object 800, parts that can abut against the weight object receiving portion 900 have the same outer shapes as those of the weight object 200 in the fixed state (FIG. 7). For this reason, the weight object 800 is hereinafter shown with the same reference symbols as in the weight object 200.

The inner part 804 includes an upward-facing surface 222 on the one side thereof. The inner part 804 also includes an extending portion 224 that is inserted into the recess 314 of the weight object receiving portion 900. The extending portion 224 is a one-side end part of the inner part 804. The extending portion 224 includes a part that extends further toward the one side than the one-side end of the outer part 802. The upward-facing surface 222 is the upper surface of the extending portion 224.

The outer part 802 includes a downward-facing surface 226 on the other side thereof. The outer part 802 also includes an extending portion 228 that extends on the upper side of the upward-facing surface 322. The extending portion 228 is the other-side end part of the outer part 802. The extending portion 228 includes a part that extends further toward the other side than the other-side end of the inner part 804. The downward-facing surface 226 is the lower surface of the extending portion 228.

The outer part 802 includes an erecting surface 230 on the one side thereof. The erecting surface 230 is a surface that faces the one side.

The erecting surface 230 is the one-side end surface of the outer part 802.

The inner part 804 includes an erecting surface 232 on the other side thereof. The erecting surface 232 is a surface that faces the other side. The erecting surface 232 is the other-side end surface of the inner part 804.

For fixing the weight object 800, the weight object 800 is placed on the fixed part 902, and then the movable part 904 is attached to the fixed part 902. The movable part 904 moves during this attaching process. During this movement, the erecting surface 312 of the movable part 904 abuts against the erecting surface 230, and the downward-facing surface 316 presses the upward-facing surface 222. When the movable part 904 has been completely fixed, the weight object 800 is subjected to the same forces as the weight object 200 in the fixed state (FIG. 7). This means that the weight object 800 is in the fixed state.

Figure 17:
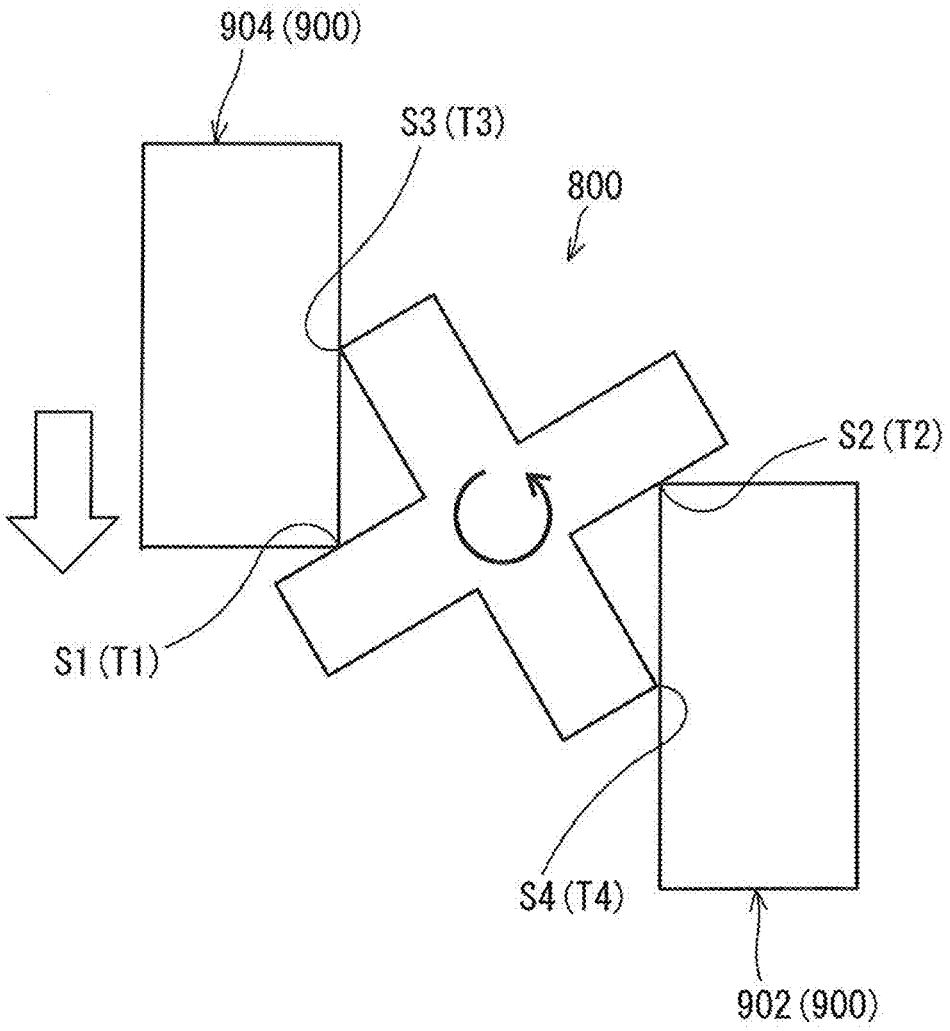
FIG. 17 is a schematic diagram showing a mechanism of the ninth embodiment.

FIG. 17 is a schematic diagram for illustrating the ninth embodiment. The weight object receiving portion 900 includes the fixed part 902 and the movable part 904. When the movable part 904 is attached to the fixed part 902, the movable part 904 moves with respect to the fixed part 902. During the process of attaching the movable part 904, the first abutment part T1 of the movable part 904 presses the first contact part S1 of the weight object 800, and at the same time, the second abutment part T2 of the fixed part 902 presses the second contact part S2 of the weight object 800. As a result, a rotational force is applied to the weight object 800. The rotation of the weight object 800 is stopped by the third abutment part T3 and the fourth abutment part T4, which prevents the rotation of the weight object 800. As a result, the movable part 904 is fixed at a predetermined position, and at the same time, the fixed state of the weight object 800 is achieved. Thus, the ninth embodiment has a shape change mechanism dm6 in which a part (movable part 904) of the weight object receiving portion 900 moves. The first abutment part T1 and the third abutment part T3 are positioned on the movable part 904. The second abutment part T2 and the fourth abutment part T4 are positioned on the fixed part 902. By moving the movable part 904, the first contact part S1 and the second contact part S2 are pressed against the weight object receiving portion 900, and, as a reaction of the pressing, a rotational force is applied to the weight object 800 from the first abutment part T1 and the second abutment part T2.

As explained above, in each embodiment, the weight object or the weight object receiving portion has a shape change mechanism that enables the weight object or the weight object receiving portion to change a shape of itself. In the first to eighth embodiments, the weight object has a shape change mechanism. In the ninth embodiment, the weight object receiving portion has a shape change mechanism.

When a shape is changed by the shape change mechanism, predetermined parts of the weight object are pressed against predetermined parts of the weight object receiving portion, which causes, as a reaction, a rotational force applied to the weight object. The weight object is about to rotate due to the rotational force, but other parts of the weight object receiving portion prevent the rotation. The weight object is fixed by maintaining a state in which the rotational force and the rotation prevention force are balanced.

The shape change mechanism changes the relative positional relationship between two portions. This relative positional change causes the weight object to be pressed against the weight object receiving portion at the two portions. The pressed positions of the weight object receiving portion can be rotational force applying parts. In the above-described first to ninth embodiments, the first abutment part T1 and the second abutment part T2 are the rotational force applying parts. The rotational force is caused as a reaction of pressing force generated when the weight object is pressed against the weight object receiving portion due to the shape change brought by the shape change mechanism. Simultaneously with the application of the rotational force, the weight object is brought into contact with the weight object receiving portion at a position(s) different from the rotational force applying parts, whereby the rotation of the weight object is prevented. The position(s) that stops the rotation of the weight object that would be otherwise brought by the rotational force to prevent the rotation of the weight object is referred to as a rotation prevention part(s). The rotation prevention part is located at a position that abuts against the weight object in a state where the rotational force is applied to the weight object. In the first to ninth embodiments, the third abutment part T3 and the fourth abutment part T4 are the rotation prevention parts.

FIG. 10D, FIG. 11D and FIG. 12D show forces F1 to F4 that are applied to the weight object from the weight object receiving portion. The forces F1 to F4 indicate force components related to the rotation of the weight object.

The force F1 is applied to the weight object from the first abutment part T1 and the force F2 is applied to the weight object from the second abutment part T2. The force F1 and the force F2 are the rotational force received from the rotational force applying parts. The force F1 and the force F2 constitute a couple of forces that rotates the weight object. The force F1 and the force F2 are caused as reaction of the pressing force applied to the weight object receiving portion from the weight object by the shape change mechanism. On the other hand, the force F3 is applied to the weight object from the third abutment part T3, and the force F4 is applied to the weight object from the fourth abutment part T4. The force F3 and the force F4 are rotation prevention force received from the rotation prevention parts. The rotation prevention parts each have a shape capable of physically stopping the rotation of the weight object. The force F3 and force F4 are caused as reaction generated when the third contact part S3 and the fourth contact part S4 are pressed against the rotation prevention parts. The force F3 and the force F4 constitute a couple of forces that prevents the rotation of the weight object. The moment of the couple of forces (F1, F2) that rotates the weight object is balanced with the moment of the couple of forces (F3, F4) that prevents the rotation of the weight object. Note that forces applied to the weight object from the abutment parts also include force components that are not involved in the rotation of the weight object, but these forces are also balanced as a whole. Accordingly, the weight object stays still in the state of receiving the rotational force and the rotation prevention force, whereby the fixed state is achieved. In the fixed state, pressing force acts on each contact position between the weight object and the weight object receiving portion. Accordingly, static friction force is increased at each contact position by the pressing force. The static friction force increases fixing strength of the fixed state.

A reference symbol z2 in FIG. 10D shows the center line of the rotation of the weight object 200*a* caused by the rotational force. Since the center line z2 extends perpendicularly to the drawing sheet of FIG. 10D, the center line z2 is indicated by a point. The position of the center line z2 is determined by the positional relationship between the rotational force applying parts T1, T2 and the rotation prevention parts T3, T4. Even when the weight object does not rotate as in the fourth embodiment (FIG. 11A to FIG. 11D), the rotational center line z2 can be determined by the positional relationship between the rotational force applying parts T1, T2 and the rotation prevention parts T3, T4.

In embodiments other than the fourth embodiment, the rotation angle of the weight object is small. For example, in the third embodiment (FIG. 10A to FIG. 10D), the rotation angle of the weight object 200*a* from the unfixed state (FIG. 10B) to the fixed state (FIG. 10C) is small. In the unfixed state, the weight object 200*a* is disposed at a normal position from which the weight object 200*a* can be shifted to the fixed state only by activating the shape change mechanism. In this unfixed state, a gap between the weight object 200*a* and the weight object receiving portion 300*a* is small. For this reason, the simultaneous abutment between the weight object 200*a* and the weight object receiving portion 300*a* at the rotational force applying parts T1, T2 and the rotation prevention parts T3, T4 can be achieved by slight shape change. Accordingly, the activation (operation) of the shape change mechanism (rotation of a screw) can be easily carried out. The minimum rotation angle of the weight object 200*a* for the mutual shift between the fixed state and the unfixed state may be, for example, set to be less than or equal to 7°, further set to be less than or equal to 5°, and even set to be less than or equal to 3°. The minimum rotation angle is the minimum value of rotation angle required for shift from the fixed state to the unfixed state. In the determination of the minimum rotation angle, the shift to the unfixed state can be confirmed as being completed when the magnitude of the rotational force caused by the shape change of the shape change mechanism is reduced to zero. As described above, the lower limit value of the minimum rotation angle can be set to 0°. Since the minimum rotation angle is small, the mutual shift between the fixed state and the unfixed state can be easily carried out.

From the viewpoint of effectively applying the rotational force, it is preferable that forces acting in opposite directions to each other are applied to the weight object from two positions. In the first to ninth embodiments, the rotational force applying parts are located at two positions apart from each other (the first abutment part T1 and the second abutment part T2). The moment of the rotational force is increased by the two rotational force applying parts located apart from each other. Further, from the viewpoint of effectively preventing the rotation of the weight object, it is preferable that forces acting in opposite directions to each other are applied to the weight object from two positions. By applying the forces from the two positions apart from each other, the rotation of the weight object is surely prevented. In the first to ninth embodiments, the rotation prevention parts are located at two positions apart from each other (the third abutment part T3 and the fourth abutment part T4).

It is preferable that the first contact part S1 (first abutment part T1) is disposed on the one side and the second contact part S2 (second abutment part T2) is disposed on the other side. By increasing the distance between the first contact part S1 (first abutment part T1) and the second contact part S2 (second abutment part T2), the moment of the rotational force is increased. The third contact part S3 (third abutment part T3) is disposed on the one side, and the fourth contact part S4 (fourth abutment part T4) is disposed on the other side, which can effectively prevent the rotation of the weight object. The rotation is further surely prevented by increasing the distance between the third contact part S3 (third abutment part T3) and the fourth contact part S4 (fourth abutment part T4). The present disclosure, however, is not limited to these arrangements. For example, in the embodiment of FIG. 8B, the first abutment part T1 and the second abutment part T2 are located relatively close to each other. The abutment parts T1 and T2, however, are located apart from each other, and can generate a rotational force. That is, the first abutment part T1 and the second abutment part T2 do not have to be separately disposed on the two different sides, i.e., the one side and the other side. Similarly, the third abutment part T3 and the fourth abutment part T4 can be located relatively close to each other. That is, the third abutment part T3 and the fourth abutment part T4 do not have to be separately disposed on the two different sides, i.e., the one side and the other side.

In the first embodiment (FIG. 7), the third embodiment (FIG. 10C), the fourth embodiment (FIG. 11C), and the fifth embodiment (FIG. 12C), the following configurations (a1) to (a4) are adopted.

(a1) The first contact part S1 (first abutment part T1) is positioned on the one side of the inner member.

(a2) The second contact part S2 (second abutment part T2) is positioned on the other side of the outer member.

(a3) The third contact part S3 (third abutment part T3) is positioned on the one side of the outer member.

(a4) The fourth contact part S4 (fourth abutment part T4) is positioned on the other side of the inner member.

In this structure, the positions of the four contact parts are effectively located apart from each other. The distance between the first contact part S1 and the second contact part S2 is increased, and the distance between the third contact part S3 and the fourth contact part S4 is also increased. Accordingly, the moment of the rotational force and the moment of the rotation prevention force can be increased, which can improve the fixing strength of the weight object in the fixed state.

In the second embodiment (FIG. 8B) and the sixth embodiment (FIG. 13), the following configurations (b1) to (b4) are adopted.

(b1) The first contact part S1 (first abutment part T1) is positioned at the tip part of the coupling member.

(b2) The second contact part S2 (second abutment part T2) is positioned on the one side of the inner member.

(b3) The third contact part S3 (third abutment part T3) is positioned on the one side of the outer member.

(b4) The fourth contact part S4 (fourth abutment part T4) is positioned on the other side of the inner member.

In this structure, the tip part of the coupling member can be pressed against the weight object receiving portion, and the axial force of the coupling member can be directly converted into the rotational force applied on the weight object. In addition, the distance between the third abutment part T3 and the fourth abutment part T4 is increased to surely prevent the rotation of the weight object.

In the second embodiment (FIG. 8B), the fifth contact part S5 (fifth abutment part T5) is further provided on the other side of the outer member. On the other hand, in the sixth embodiment (FIG. 13), the other side part of the outer member does not abut against the weight object receiving portion, and does not play a part in achieving the fixed state. Various configurations are adoptable by changing shape relationship between the weight object and the weight object receiving portion.

In the eighth embodiment (FIG. 15), the following configurations (c1) to (c4) are adopted.

(c1) The first contact part S1 (first abutment part T1) is positioned at the tip part of the coupling member.

(c2) The second contact part S2 (second abutment part T2) is positioned on the one side of the inner member.

(c3) The third contact part S3 (third abutment part T3) is positioned on the one side of the inner member and on the upper side of the second contact part S2 (second abutment part T2).

(c4) The fourth contact part S4 (fourth abutment part T4) is positioned on the other side of the outer member.

In the eighth embodiment (FIG. 15), the position of the fourth contact part S4 (fourth abutment part T4) is adjusted by providing the downward extending portion 712 on the other side of the outer member.

In the seventh embodiment (FIG. 14), the following configurations (d1) to (d4) are adopted instead of the combination of an inner member and an outer member.

(d1) The first contact part S1 (first abutment part T1) is positioned at the tip part of the connected member.

(d2) The second contact part S2 (second abutment part T2) is positioned on the one side of the main member.

(d3) The third contact part S3 (third abutment part T3) is positioned on the one side of the main member and on the upper side of the second contact part S2 (second abutment part T2).

(d4) The fourth contact part S4 (fourth abutment part T4) is positioned on the other side of the main member.

Thus, various structures can be adopted as the weight object and the weight object receiving portion. The shapes and dimensions of the weight object and the weight object receiving portion can be determined in consideration of, for example, reliability of fixation of the weight object, the posture of the weight object in the fixed state, the ease of forming the weight object receiving portion.

When a weight object including an outer member and an inner member is used, the first contact part S1 and the second contact part S2 are preferably separately disposed to the two different members. That is, when the inner member has the first contact part S1, the outer member preferably has the second contact part S2. In this configuration, the positional relationship between the first contact part S1 and the second contact part S2 can be changed by changing the positional relationship between the outer member and the inner member. Accordingly, the mutual shift between the fixed state and the unfixed state can be easily carried out.

When a weight object including an outer member and an inner member is used, the third contact part S3 and the fourth contact part S4 are preferably separately disposed to the two different members. That is, when the outer member has the third contact part S3, the inner member preferably has the fourth contact part S4. In this configuration, the positional relationship between the third contact part S3 and the fourth contact part S4 can be changed by changing the positional relationship between the outer member and the inner member. Accordingly, the mutual shift between the fixed state and the unfixed state can be easily carried out.

It is preferable that the first contact part S1 is positioned on the one side of the weight object, and the second contact part S2 is positioned on the other side of the weight object. This structure increases the distance between the first abutment part T1 and the second abutment part T2, which can increase the moment of the rotational force. As a result, the pressing force applied to the weight object at the rotation prevention parts is increased, and the reliability of the fixed state can be enhanced.

It is preferable that the third contact part S3 is positioned on the one side of the weight object, and the fourth contact part S4 is positioned on the other side of the weight object. This structure increases the distance between the third abutment part T3 and the fourth abutment part T4, which can firmly prevent the rotation of the weight object. Accordingly, the reliability of the fixed state can be enhanced.

From the viewpoint of increasing the rotational force, the rotational force applying parts are preferably located at two positions that generate forces acting in opposite directions to each other. In the first embodiment (FIG. 7), the first contact part S1 abuts against the first abutment part T1 from the lower side, whereas the second contact part S2 abuts against the second abutment part T2 from the upper side. In the second embodiment (FIG. 8B), the first contact part S1 abuts against the first abutment part T1 from the upper side, whereas the second contact part S2 abuts against the second abutment part T2 from the lower side. Accordingly, the force applied by the first abutment part T1 and the force applied by the second abutment part T2 include force components acting in opposite directions to each other. As a result, the rotational force (couple of forces) is effectively generated.

From the viewpoint of easily achieving the fixed state, the weight object and the weight object receiving portion are configured such that the contacts at the rotational force applying parts and the contacts at the rotation prevention parts occur at the same time. That is, the rotation prevention parts are located at positions that are in contact with the weight object when the rotational force is applied by the rotational force applying parts.

Figure 18:
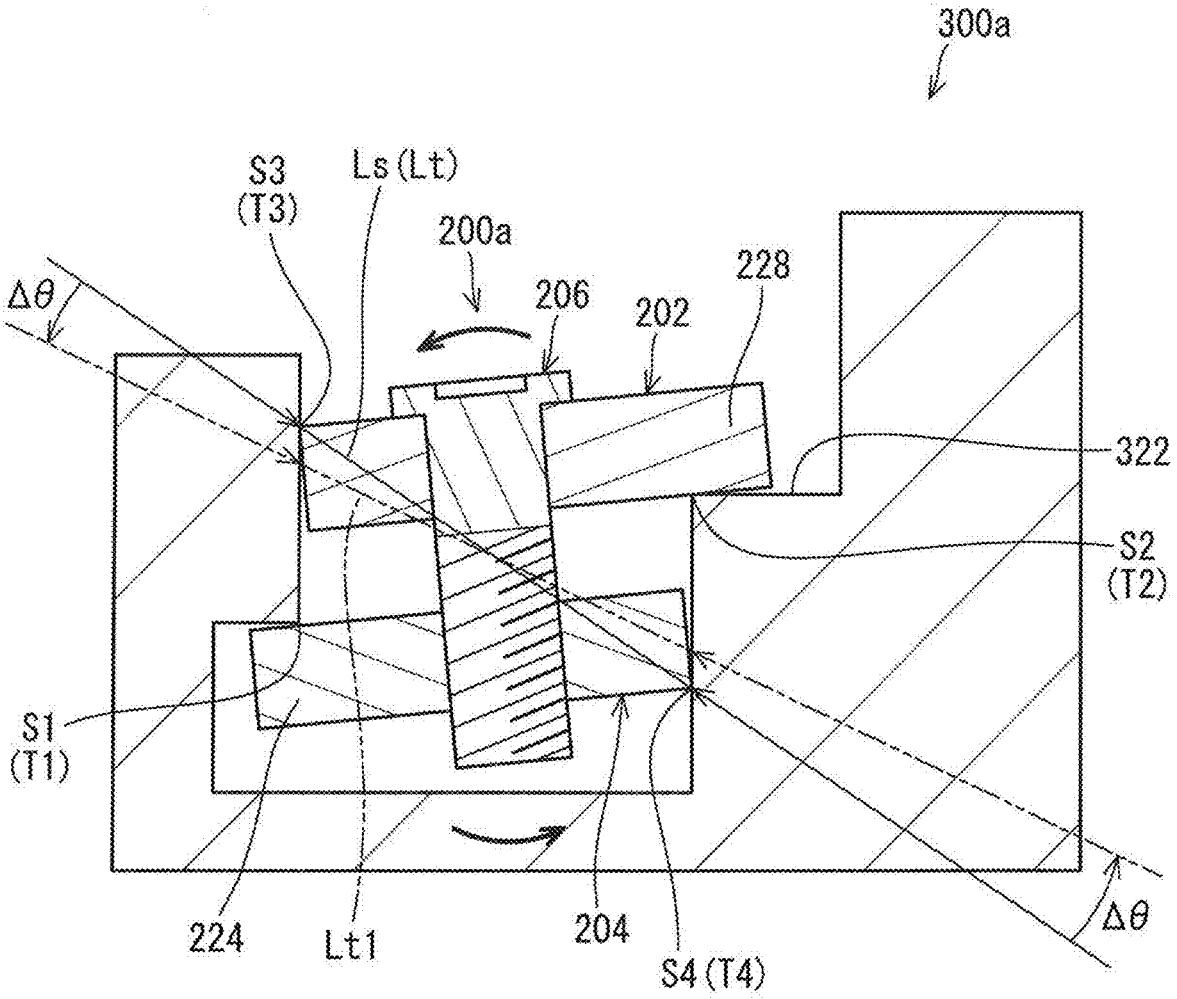
FIG. 18 is the same cross-sectional view as FIG. 10C.

The rotation prevention parts each preferably have a shape that physically prevents the rotation of the weight object caused by the rotational force. FIG. 18 is the cross-sectional view of the third embodiment as with FIG. 10C. A double-pointed arrow Ls in FIG. 18 shows a distance between the third contact part S3 and the fourth contact part S4 in the fixed state. The distance Ls is equal to a distance Lt between the third abutment part T3 and the fourth abutment part T4. An excessive rotation distance Lt1 is defined as a distance between the third abutment part T3 and the fourth abutment part T4 when assuming that the weight object is excessively rotated by a minute angle $\Delta\theta$ after the weight object is set to be the fixed state. The excessive rotation distance Lt1 is smaller than the distance Lt. That is, the excessive rotation distance Lt1 is smaller than the distance Ls. Accordingly, such an excessive rotation is prevented. The third abutment part T3 and the fourth abutment part T4 function as rotation prevention parts. This structure is an example of a shape that physically prevents the rotation of the weight object caused by the rotational force.

As understood from the third embodiment (FIG. 10C), the fourth embodiment (FIG. 11C), and the fifth embodiment (FIG. 12C), the posture of the weight object in the fixed state can be adjusted by adjusting the dimensional relationship between the weight object and the weight object receiving portion. In addition, as shown in the fourth embodiment (FIG. 11C), the fixed state can be achieved without rotating the weight object 200*b*. The fixing structures according to the present disclosure have excellent design flexibility for achieving of a fixed state.

In the first embodiment (FIG. 7), the fourth embodiment (FIG. 11C), and the ninth embodiment (FIG. 16), the contact at each contact part in the fixed state is achieved by surface-to-surface contact. In the remaining embodiments, the contact at each contact part in the fixed state is shown as point contact in the drawings, and is actually achieved by line contact. By adjusting the shape of each contact part while considering the posture of the weight object in the fixed state, surface-to-surface contact can be achieved. The surface-to-surface contact suppresses wear and damage of the contact parts, and can accomplish stable fixing. When the contact at each contact part in the fixed state is achieved by line contact (or point contact), the contact pressure can be increased, and the static frictional force can be enhanced.

As described above, in the first embodiment, the weight object receiving portion 300 constitutes the groove 302. The cross-sectional structure of the weight object receiving portion 300 shown in FIG. 5 remains the same at each position in the extending direction of the groove 302. Accordingly, the weight object 200 can move in the groove 302 when weight object 200 is in the unfixed state. In addition, the fixed state can be achieved at every position in the groove 302. Also in the second to ninth embodiments, by extending the weight object receiving portion without changing its cross-sectional shape, the weight object can be fixed at different positions.

As the movable range of the weight object becomes larger, the degree of freedom in adjusting the position of the center of gravity of the head is increased. The movable range of the weight object preferably includes an area that extends from a position located on the toe side with respect to the head center of gravity to a position located on the heel side with respect to the head center of gravity. The movable range of the weight object preferably also includes an area that extends from a position located on the toe side with respect to the face center to a position located on the heel side with respect to the face center. The position of the weight object can be considered as the position of the center of gravity of the weight object.

The direction of the rotation of the weight object caused by the rotational force is substantially orthogonal to the moving direction of the weight object. In other words, the center line z2 (FIG. 10D) of the rotation of the weight object caused by the rotational force is substantially parallel to the moving direction of the weight object. The moving direction of the weight object can be considered as the direction of a moving pass L1 of the center of gravity of the weight object (see FIG. 1). When the moving pass L1 is a curved line, a tangent line to the moving pass L1 is considered. When the weight object is located at a certain position, a point on the moving pass L1 closest to the center of gravity of the weight object at the certain position is determined. An angle formed by a tangent line to the moving pass L1 at that point and the center line z2 of the weight object at the certain position is determined. When the absolute value of the angle is 100 or less, the rotational center line z2 can be considered as substantially parallel to the moving direction of the weight object.

As a structure for fixing the weight object, one may consider a structure in which a weight object receiving portion is sandwiched between an outer member and an inner member. For achieving this structure, it is necessary to form a protrusion in the weight object receiving portion to be sandwiched between the outer member and the inner member. In this case, the shape of the weight object receiving portion can become complicated, and the undercut part can be increased. As a result, the number of separate parts of a mold for forming the weight object receiving portion can be increased. On the other hand, in the above embodiments, the structure of the weight object receiving portion can be simplified.

In the second embodiment (FIG. 8B), the sixth embodiment (FIG. 13), the seventh embodiment (FIG. 14), and the eighth embodiment (FIG. 15), when the weight object is in the fixed state, the coupling member (or the connected member) abuts against the weight object receiving portion. In this case, the coupling member (or the connected member) can press the weight object receiving portion with its the axial force, and the abutment part (pressed part) of the weight object receiving portion can be the rotational force applying part (first abutment part T1).

In the first embodiment (FIG. 7), the third embodiment (FIG. 10C), the fourth embodiment (FIG. 11C), and the fifth embodiment (FIG. 12C), when the weight object is in the fixed state, the coupling member is not in contact with the weight object receiving portion. In this case, of the weight object receiving portion, an abutment part that is in contact with a part of the weight object other than the coupling member can be the rotational force applying part (first abutment part T1).

The shape change mechanism may be provided in a weight object as in the first to eighth embodiments, or may be provided in a weight object receiving portion as in the ninth embodiment. In the first to eighth embodiments, a screw mechanism is provided to change the shape of the weight object and to make the weight object press the weight object receiving portion, and the rotational force is obtained as the reaction of the pressing.

The first embodiment (FIG. 7), the third embodiment (FIG. 10C), the fourth embodiment (FIG. 11C), and the fifth embodiment (FIG. 12C) each adopt a structure in which a part of the weight object receiving portion is present on the one side and upper side of the inner member, and a part of the weight object receiving portion is present on the other side and lower side of the outer member. In this case, when the distance between the inner member and the outer member is decreased, a part on the one side and upper side of the inner member and a part on the other side and lower side of the outer member are pressed against the weight object receiving portion, whereby a rotational force is obtained. As another structure, for example, a rotational force may be obtained as the distance between the inner member and the outer member is increased. In this case, for example, a structure in which a part of the weight object receiving portion is located on the one side and lower side of the inner member and a part of the weight object receiving portion is located on the other side and upper side of the outer member can be adopted. A rotational force can be applied to the weight object by a structure in which forces that act in opposite directions to each other are applied to the weight object from two positions apart from each other. Further, the fixed state can be achieved by the weight object receiving portion configured such that it can receive the rotational force and prevent the rotation of the weight object. According to the present disclosure, various configurations for the weight object and the weight object receiving portion can be designed.

The shape change mechanism which changes the relative positional relationship between the outer member and the inner member is not limited to a screw mechanism, and known mechanisms can be adopted. For example, an alternate mechanism that can perform an alternate action can be adopted. The alternate mechanism is generally adopted in a push button and the like. The alternate mechanism makes it possible to switch, with a single button, between a state in which the two members are located close to each other and a state in which the two members are located far from each other.

Examples of a structure in which the weight object receiving portion has a shape change mechanism include the ninth embodiment and a structure in which the movable part 904 of the ninth embodiment is slidably attached.

The following Clauses are a part of the invention included in the present disclosure.

[Clause 1]

A golf club head including:

a weight object; and a weight object receiving portion that is provided on an outer surface of the golf club head and to which the weight object is attached, wherein when the weight object is disposed in the weight object receiving portion, the weight object is shiftable between a fixed state and an unfixed state, the weight object or the weight object receiving portion has a shape change mechanism that enables the weight object or the weight object receiving portion to change a shape of itself, the weight object receiving portion includes:

at least one rotational force applying part that is configured to apply a rotational force to the weight object, the rotational force being caused as a reaction generated when the weight object is pressed against the weight object receiving portion by the change of the shape of the weight object or the weight object receiving portion; and at least one rotation prevention part that is located at a position against which the weight object abuts when the rotational force is applied to the weight object, and that is configured to stop the weight object from being rotated by the rotational force to prevent rotation of the weight object, and the fixed state is achieved by maintaining a state in which the weight object is pressed against the rotation prevention part by the rotational force.

[Clause 2]

The golf club head according to clause 1, wherein the weight object includes a first contact part, a second contact part, a third contact part, and a fourth contact part that are located apart from each other, the weight object receiving portion includes:

a first abutment part and a second abutment part that respectively abut against the first contact part and the second contact part when the weight object is in the fixed state, and apply the rotational force to the weight object; and a third abutment part and a fourth abutment part against which the third contact part and the fourth contact part of the weight object are respectively pressed by the rotational force, and prevent the rotation of the weight object, the at least one rotational force applying part comprises a plurality of rotational force applying parts, the at least one rotation prevention part comprises a plurality of rotation prevention parts, the first abutment part and the second abutment part are the rotational force applying parts, and the third abutment part and the fourth abutment part are the rotation prevention parts.

[Clause 3]

The golf club head according to clause 2, wherein the weight object includes an outer member, an inner member, and a coupling member that connects the outer member and the inner member, the shape change mechanism is a mechanism that changes a relative positional relationship between the inner member and the outer member, the first contact part is located on one side of the inner member, the second contact part is located on other side of the outer member, the third contact part is located on the one side of the outer member, the fourth contact part is located on the other side of the inner member, and the rotational force is applied to the weight object from the first abutment part and the second abutment part of the weight object receiving portion by bringing the outer member and the inner member closer to each other.

[Clause 4]

The golf club head according to clause 2, wherein the weight object includes an outer member, an inner member, and a coupling member that connects the outer member and the inner member, the weight object has the shape change mechanism, the shape change mechanism is a mechanism that changes a protruding length of the coupling member from the inner member while changing a relative positional relationship between the outer member and the inner member, the first contact part is located at a tip part of the coupling member, the second contact part is located on one side of the inner member, the third contact part is located on the one side of the outer member, the fourth contact part is located on other side of the inner member, and the rotational force is applied to the weight object from the first abutment part and the second abutment part of the weight object receiving portion by bringing the outer member and the inner member closer to each other.

[Clause 5]

The golf club head according to clause 2, wherein the weight object includes an outer member, an inner member, and a coupling member that connects the outer member and the inner member, the weight object has the shape change mechanism, the shape change mechanism is a mechanism that changes a protruding length of the coupling member from the inner member while changing a relative positional relationship between the outer member and the inner member, the first contact part is located at a tip part of the coupling member, the second contact part is located on one side of the inner member, the third contact part is located on the one side of the inner member and on an upper side of the second contact part, the fourth contact part is located on other side of the outer member, and the rotational force is applied to the weight object from the first abutment part and the second abutment part of the weight object receiving portion when the protruding length is increased and the tip part of the coupling member abuts against the weight object receiving portion.

[Clause 6]

The golf club head according to clause 2, wherein the weight object includes a main member and a connected member that is movably connected to the main member, the shape change mechanism is a mechanism that changes a protruding length of the connected member from the main member, the first contact part is located at a tip part of the connected member, the second contact part is located on one side of the main member, the third contact part is located on the one side of the main member and on an upper side of the second contact part, the fourth contact part is located on other side of the main member, and the rotational force is applied to the weight object from the first abutment part and the second abutment part of the weight object receiving portion when the protruding length is increased and the tip part of the connected member abuts against the weight object receiving portion.

[Clause 7]

The golf club head according to clause 2, wherein the weight object receiving portion includes a fixed part and a movable part, the shape change mechanism is a mechanism in which the movable part moves, the first abutment part and the third abutment part are positioned on the movable part, the second abutment part and the fourth abutment part are positioned on the fixed part, and the first contact part and the second contact part are pressed against the weight object receiving portion by moving the movable part, and as a reaction of the pressing, the rotational force is applied to the weight object from the first abutment part and the second abutment part.

[Clause 8]

The golf club head according to any one of clauses 1 to 7, wherein the weight object receiving portion constitutes a groove, when the weight object is in the unfixed state, the weight object is capable of moving in the groove, and the fixed state is achieved at positions in the groove.

[Clause 9]

The golf club head according to any one of clauses 1 to 8, wherein the golf club head includes a sole portion, and the weight object receiving portion is provided in the sole portion.

LIST OF REFERENCE SYMBOLS

100 Golf club head
102, 122 Head body
104 Face portion
106 Crown portion
108 Sole portion
110 Hosel portion
120 Golf club head
200, 200*a*, 200, 200*c*, 200*d* Weight object
202 Outer member
204 Inner member
206 Coupling member
300, 300*a* Weight object receiving portion
302 Groove
400 Weight object
402 Outer member
404 Inner member
406 Coupling member
500, 500*a* Weight object receiving portion
600 Weight object
602 Main member
604 Connected member
700 Weight object
702 Outer member
704 Inner member
706 Coupling member
800 Weight object
900 Weight object receiving portion
902 Fixed part
904 Movable part
S1 First contact part
S2 Second contact part
S3 Third contact part
S4 Fourth contact part
T1 First abutment part
T2 Second abutment part
T3 Third abutment part
T4 Fourth abutment part
dm1, dm2, dm3, dm4, dm5, dm6 Shape change mechanism
z1 Rotational center line The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a weight object; and a weight object receiving portion that is provided on an outer surface of the golf club head and to which the weight object is attached, wherein the weight object receiving portion includes a groove, the weight object includes an outer member, an inner member, and a coupling member that connects the outer member and the inner member the groove includes a first wall that is located on one side relative to the coupling member and a second wall that is located on other side relative to the coupling member, the first wall includes:

a first erecting surface that faces the other side; and a recess that is located on a lower side of the first erecting surface, the recess being recessed toward the one side and including a first downward-facing surface that faces downward, and the first downward-facing surface being inclined such that the first downward-facing surface goes upward as it goes toward the other side, the second wall includes:

a second erecting surface that faces the one side; and a first upward-facing surface that is located on an upper side of the second erecting surface, the first upward-facing surface being inclined such that the first upward-facing surface goes downward as it goes toward the one side, the outer member includes a third erecting surface on the one side thereof, and a second downward-facing surface on the other side thereof, the inner member includes a second upward-facing surface on the one side thereof, and a fourth erecting surface on the other side thereof, and in a fixed state in which the weight object is fixed to the groove, the first downward-facing surface abuts against the second upward-facing surface, the first upward-facing surface abuts against the second downward-facing surface, the first erecting surface abuts against the third erecting surface, the second erecting surface abuts against the fourth erecting surface, the first downward-facing surface is inclined relative to a direction perpendicular to a rotational center line of the coupling member, and the first upward-facing surface is inclined relative to the direction perpendicular to the rotational center line of the coupling member.

2. The golf club head according to claim 1, wherein the weight object includes a first contact part, a second contact part, a third contact part, and a fourth contact part that are located apart from each other, the first contact part is the second upward-facing surface, the second contact part is the second downward-facing surface, the third contact part is the third erecting surface, the fourth contact part is the fourth erecting surface, the groove includes:

a first abutment part and a second abutment part that respectively abut against the first contact part and the second contact part when the weight object is in the fixed state, and apply a rotational force to the weight object; and a third abutment part and a fourth abutment part against which the third contact part and the fourth contact part of the weight object are respectively pressed by the rotational force, and prevent the weight object from being rotated, the first abutment part is the first downward-facing surface, the second abutment part is the first upward-facing surface, the third abutment part is the first erecting surface, and the fourth abutment part is the second erecting surface.

3. The golf club head according to claim 1, wherein the coupling member is a screw that includes a head portion and a male screw portion, the head portion is rotatably retained by the outer member, the inner member includes a female screw hole, and the male screw portion is screw-connected to the female screw hole.

4. The golf club head according to claim 3, wherein the fixed state is achieved by tightening the screw, an unfixed state in which the weight object is not fixed to the groove is achieved by loosening the screw, and the unfixed state includes a state in which the weight object does not fall out of the groove.

5. The golf club head according to claim 3, wherein the fixed state is achieved by tightening the screw, an unfixed state in which the weight object is not fixed to the groove is achieved by loosening the screw, and the groove allows the weight object in the unfixed state to move in the groove.

6. The golf club head according to claim 1, wherein the groove is curved along a length thereof in a bottom plan view of the golf club head.

7. The golf club head according to claim 6, wherein the groove is curved along the length thereof such that a middle portion of the groove is farther from a face portion of the golf club head than opposite ends of the groove are from the face portion of the golf club head.

8. The golf club head according to claim 1, wherein the outer member of the weight object is spaced from the inner member of the weight object such that no portion of the outer member touches any portion of the inner member.

9. The golf club head according to claim 1, wherein in a case where the weight object is in the groove of the weight object receiving portion the weight object is settable between the fixed state and an unfixed state.

10. The golf club head according to claim 1, wherein the weight object receiving portion includes a fixed part and a movable part.

11. The golf club head according to claim 1, further comprising:

a front portion including a face portion; and a rear portion opposite the front portion and including a sole portion, wherein the weight object receiving portion is entirely in the sole portion.

12. The golf club head according to claim 1, wherein, of the groove of the weight object receiving portion, a part that receives the inner member is asymmetrical in a side sectional view of the golf club head.

13. The golf club head according to claim 1, wherein the inner member of the weight object is asymmetrical in a side sectional view of the golf club head.

14. The golf club head according to claim 1, wherein the golf club head is configured such that as the coupling member is tightened, the weight object rotates about a rotational axis that is perpendicular to the rotational center line of the coupling member.

15. A golf club head comprising:

a weight object; and a weight object receiving portion that is provided on an outer surface of the golf club head and to which the weight object is attached, wherein the weight object receiving portion includes a groove, the groove includes a first wall that is located on one side and a second wall that is located on other side, the first wall includes: a first erecting surface that faces the other side; and a recess that is located on a lower side of the first erecting surface, the recess being recessed toward the one side and including a first downward-facing surface that faces downward, and the first downward-facing surface being inclined such that the first downward-facing surface goes upward as it goes toward the other side, the second wall includes: a second erecting surface that faces the one side; and a first upward-facing surface that is located on an upper side of the second erecting surface, the first upward-facing surface being inclined such that the first upward-facing surface goes downward as it goes toward the one side, the weight object includes an outer member, an inner member, and a coupling member that connects the outer member and the inner member, the outer member includes a third erecting surface on the one side thereof, a second downward-facing surface on the other side thereof, and a lower surface that is located between the third erecting surface and the second downward-facing surface, the inner member includes a second upward-facing surface on the one side thereof, a fourth erecting surface on the other side thereof, and an upper surface that is located between the second upward-facing surface and the fourth erecting surface, in a fixed state in which the weight object is fixed to the groove, the first downward-facing surface abuts against the second upward-facing surface, the first upward-facing surface abuts against the second downward-facing surface, the first erecting surface abuts against the third erecting surface, and the second erecting surface abuts against the fourth erecting surface, the lower surface of the outer member does not abut against the first wall or the second wall of the groove of the weight object receiving portion, and the upper surface of the inner member does not abut against the first wall or the second wall of the groove of the weight object receiving portion.

* * * * *